US008025169B2

(12) United States Patent
Zimmerman

(10) Patent No.: US 8,025,169 B2
(45) **Date of Patent: *Sep. 27, 2011**

(54) SELF-ANCHORING BEVERAGE CONTAINER WITH DIRECTIONAL RELEASE AND ATTACHMENT CAPABILITY

(76) Inventor: Israel Harry Zimmerman, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/676,574

(22) PCT Filed: Sep. 8, 2008

(86) PCT No.: PCT/US2008/075592

§ 371 (c)(1),
(2), (4) Date: Mar. 4, 2010

(87) PCT Pub. No.: WO2009/038991

PCT Pub. Date: Mar. 26, 2009

(65) Prior Publication Data

US 2010/0187240 A1 Jul. 29, 2010

Related U.S. Application Data

(63) Continuation-in-part of application No. 11/859,751, filed on Sep. 22, 2007.

(51) Int. Cl.

| | |
|---|---|
| ***A47G 19/22*** | (2006.01) |
| ***A47G 23/03*** | (2006.01) |
| ***A47G 29/093*** | (2006.01) |
| *A47G 23/02* | (2006.01) |

(52) U.S. Cl. ..... 220/23.89; 220/23.86; 220/630; 220/737; 220/739; 220/770; 248/311.2; 248/346.11; 248/362

(58) Field of Classification Search ..... 220/23.89, 220/483, 710.5, 737, 739–742, 770, 23.86; 248/205.5, 206.2, 205.7–205.9, 309.3, 310, 248/311.2, 346.11, 362

See application file for complete search history.

(56) References Cited

U.S. PATENT DOCUMENTS 1,518,943 A * 12/1924 Story ..... 248/205.5

(Continued)

FOREIGN PATENT DOCUMENTS

DE 3742636 1/1989

(Continued)

OTHER PUBLICATIONS

International Search Report and Written Opinion of the International Searching Authority, PCT Application No. PCT/US2008/075592, May 29, 2009, 12 pages.

(Continued)

*Primary Examiner* — J. Gregory Pickett
*Assistant Examiner* — Ned A Walker
(74) *Attorney, Agent, or Firm* — Walter W Duft

(57) ABSTRACT

A self-anchoring beverage container with directional release and attachment capability has a flexible nonporous base member adapted to seal to a reference surface and create a controlled pressure zone. A receptacle assembly is mounted to the base member and includes a beverage holding chamber. A communication channel in the receptacle assembly extends from the controlled pressure zone to an area of ambient pressure. A pressure control device on the receptacle assembly is adapted to alternately close the communication channel to seal the controlled pressure zone and open the communication channel to vent the controlled pressure zone to ambient pressure. The receptacle assembly further includes a grasping portion arranged to be grasped by a user. The pressure control device is operatively connected to the grasping portion for actuation to the open position when a user grasps the grasping portion during normal lifting of the beverage container from the reference surface.

21 Claims, 20 Drawing Sheets

U.S. PATENT DOCUMENTS 1,753,611 A * 4/1930 Lower ..... 215/12.1
1,778,175 A * 10/1930 Thune ..... 47/71
1,840,400 A * 1/1932 Lebherz ..... 248/362
2,083,299 A 6/1937 Hunter
2,565,793 A 8/1951 Weismantel
2,601,279 A * 6/1952 Hacus ..... 248/154
2,740,545 A * 4/1956 Bates ..... 215/394
2,782,948 A * 2/1957 Steinberg ..... 215/393
2,839,260 A * 6/1958 Jacobi, Jr. ..... 248/146
2,895,636 A * 7/1959 Martin ..... 220/574
2,908,473 A 10/1959 Snyder
2,910,264 A * 10/1959 Lindenberger ..... 248/362
2,932,119 A * 4/1960 Borah ..... 248/346.11
2,936,139 A * 5/1960 Lindstrom ..... 248/616
2,963,256 A * 12/1960 Borah ..... 248/346.04
3,094,235 A * 6/1963 Luning ..... 215/393
3,159,370 A * 12/1964 Rubinstein ..... 248/346.01
3,383,001 A * 5/1968 Wei ..... 220/4.26
3,675,886 A * 7/1972 Kampmier ..... 248/363
3,847,324 A 11/1974 Uchanski et al.
4,040,549 A 8/1977 Sadler
4,127,211 A * 11/1978 Zerbey ..... 220/212
4,137,356 A 1/1979 Shoemaker et al.
4,726,553 A * 2/1988 Wischusen, III ..... 248/146
4,756,497 A * 7/1988 Lan ..... 248/205.9
4,759,525 A 7/1988 Cross et al.
4,760,987 A 8/1988 Lan
4,836,488 A 6/1989 Ross
4,872,721 A * 10/1989 Sniadach ..... 296/97.2
4,890,760 A * 1/1990 Nicoll et al. ..... 220/495.04
4,928,848 A * 5/1990 Ballway ..... 220/23.87
4,940,138 A * 7/1990 Hornstein ..... 206/218
4,941,635 A * 7/1990 Lan ..... 248/346.11
4,955,493 A 9/1990 Touzani
4,978,566 A 12/1990 Scheurer et al.
5,040,719 A 8/1991 Ballway
5,065,973 A * 11/1991 Wang ..... 248/362
5,071,096 A * 12/1991 Hartmann et al. ..... 248/154
5,076,527 A * 12/1991 Yung-Huei ..... 248/362
5,133,524 A 7/1992 Liu
5,180,132 A 1/1993 Pearson et al.
5,186,350 A * 2/1993 McBride ..... 220/739
5,192,043 A 3/1993 Fa
5,207,076 A * 5/1993 Sciarrillo ..... 62/457.4
5,273,182 A 12/1993 Laybourne
5,282,541 A * 2/1994 Chen ..... 215/229
5,292,140 A * 3/1994 Laing ..... 280/47.33
D357,170 S 4/1995 Wellsfry
5,413,302 A 5/1995 Ferster
5,511,752 A 4/1996 Trethewey
5,531,353 A * 7/1996 Ward et al. ..... 220/729
5,667,180 A * 9/1997 Duckworth ..... 248/311.2
5,742,971 A 4/1998 Salinger
D397,915 S * 9/1998 McNaughton ..... D7/619.1
D400,763 S * 11/1998 Taylor et al. ..... D7/619.1
6,000,575 A * 12/1999 LaCour et al. ..... 220/739
6,039,206 A * 3/2000 DeFrancesco ..... 220/737
6,059,138 A * 5/2000 Labruyere ..... 220/574
D439,116 S * 3/2001 White ..... D7/619.1
6,264,054 B1 * 7/2001 Miyake et al. ..... 220/23.83
6,315,153 B1 * 11/2001 Osborn ..... 220/737
6,367,652 B1 * 4/2002 Toida et al. ..... 220/739
6,491,265 B2 * 12/2002 Tracy ..... 248/154
6,497,394 B1 * 12/2002 Dunchock ..... 248/205.8
6,511,031 B2 * 1/2003 Lin ..... 248/346.11
6,543,637 B1 * 4/2003 Osborn ..... 220/737
6,571,976 B1 * 6/2003 Sonnabend ..... 220/483
6,596,374 B1 7/2003 Adjeleian
6,745,987 B2 * 6/2004 Rousselet et al. ..... 248/363
6,776,368 B1 * 8/2004 Duncan et al. ..... 242/597.7
7,306,113 B2 * 12/2007 El-Saden et al. ..... 220/592.17
7,726,715 B2 * 6/2010 Nagasawa et al. ..... 294/64.1
2003/0102320 A1 * 6/2003 Park ..... 220/756
2004/0238541 A1 * 12/2004 Camp, Jr. ..... 220/495.04
2004/0238542 A1 * 12/2004 Camp et al. ..... 220/495.04
2006/0175506 A1 * 8/2006 Lan ..... 248/311.2
2007/0012706 A1 * 1/2007 Deadman ..... 220/737
2007/0205205 A1 * 9/2007 Kliewer ..... 220/737
2008/0093370 A1 * 4/2008 Darsey ..... 220/739
2008/0190948 A1 * 8/2008 Sayasithsena ..... 220/737
2009/0250467 A1 * 10/2009 Schmidt ..... 220/361
2009/0256043 A1 * 10/2009 Lan ..... 248/311.2

FOREIGN PATENT DOCUMENTS

JP 2004-160079 A 6/2004
JP 2006-314739 A 11/2006

OTHER PUBLICATIONS

International Preliminary Report on Patentability, PCT Application No. PCT/US2008/075592, Apr. 1, 2010, 7 pages.

* cited by examiner

SELF-ANCHORING BEVERAGE CONTAINER WITH DIRECTIONAL RELEASE AND ATTACHMENT CAPABILITY

This application is the national stage under 35 U.S.C. 371 of International Application No. PCT/US2008/075592, filed on Sep. 8, 2008, which is a continuation-in-part under 35 U.S.C. 365(c) of U.S. application Ser. No. 11/859,751, filed on Sep. 22, 2007.

BACKGROUND OF THE INVENTION

1. Field of the Invention

The present invention relates to beverage containers for holding liquid or semi-liquid contents. More particularly, the invention concerns the prevention of beverage container tipping and consequent content spillage.

2. Description of the Prior Art

By way of background, beverage containers such as glasses, mugs, cans, bottles and the like are prone to tipping and consequent content spillage due to the fact that such containers are typically tall in comparison to their supporting bottom portion. This creates a high center of gravity that renders the containers unstable when exposed to side loads, such as those that may be imparted by inadvertently knocking the container with a hand or arm, or when the container is subject to acceleration forces (lateral, vertical or in any other direction) within the confines of a moving land vehicle, aircraft or watercraft. Glasses and mugs are especially prone to major content loss in the event of tipping due to their relatively large open tops. Although this problem can be addressed with a removable cover that allows the contents of the mug or glass to be consumed through a hole or slot, as in the conventional "travel mug," such covers do not prevent spillage when the mug or glass is tipped over on its side. Moreover, the force of the tip-over can jar the cover loose, causing the contents to spill out.

It is also known to utilize a suction device to secure a beverage container to a surface and thereby stabilize the container against tipping. Such devices, however, either require the user to affirmatively place the beverage container into contact with the suction device, apply a positive downward force to secure the suction device to the surface, or perform an unlocking action to release the suction device from the surface or the container from the suction device.

It is to improvements in the foregoing field that the present invention is directed. In particular, what is needed is an improved beverage container that resists tipping and consequent beverage spillage. Preferably, this result can be achieved in a manner that does not require a user to perform any step or operation apart from normal manipulation of the container. The user should not be required to learn any new mode of container operation and the anti-tipping feature should preferably operate in "stealth mode" such that the user is not even aware that such feature is present when the container is used in normal fashion.

SUMMARY OF THE INVENTION

The foregoing problems are solved and an advance in the art is obtained by a self-anchoring beverage container with directional release and attachment capability. In one aspect, the beverage container includes a flexible nonporous base member having a lower surface that is configured to engage an external reference surface and form a substantially airtight seal therewith that defines the periphery of a controlled pressure zone between the base member and the reference surface. A receptacle assembly is mounted to the base member.

The receptacle assembly includes a beverage holding chamber having a closed bottom, a sidewall portion, and a top. A communication channel in the receptacle assembly extends from the controlled pressure zone to an area of ambient air pressure. A pressure control device on the receptacle assembly has a closed position that closes the communication channel to seal the controlled pressure zone and an open position that opens the communication channel to vent the controlled pressure zone to ambient pressure. The receptacle assembly further includes a grasping portion that is arranged to be grasped by a user during normal lifting of the beverage container from the reference surface. The pressure control device is operatively connected to the grasping portion for actuation to the open position when a user grasps the grasping portion during normal lifting of the beverage container from the reference surface. The beverage container is thus self-biased to remain affixed to the reference surface when the communication channel is closed due to the controlled pressure zone generating a partial vacuum when an attempt is made to move the beverage container without actuating the pressure control device. On the other hand, the self-biasing will be released surreptitiously and the beverage container will lift away from the reference surface without discernable resistance when the pressure control device is actuated to vent the controlled pressure zone due to the user grasping the grasping portion during normal lifting of the beverage container.

In another aspect, a self-anchoring beverage container includes a flexible nonporous seal member having a central opening that is flexed to form a lip and a skirt portion that extends outwardly from the lip. An outer cup is mounted to the seal member. The outer cup has an outer cup bottom, and outer cup sidewall portion that engages the seal member lip, and an outer cup open top. The seal member skirt has a lower surface that is configured to engage an external reference surface and form a substantially airtight seal therewith that defines a periphery of a controlled pressure zone between the seal member skirt and the reference surface. An inner cup is slideably disposed in the outer cup. The inner cup includes an inner cup bottom, a seal on a lower surface of the inner cup bottom, an inner cup sidewall portion, and an inner cup open top. A communication port in the outer cup bottom provides a communication channel extending from the controlled pressure zone. The inner cup has a lowered position wherein the seal on the inner cup bottom closes the communication channel to seal the controlled pressure zone, and a raised position wherein the seal on the inner cup bottom opens the communication channel to vent the controlled pressure zone to ambient pressure. The inner cup includes a grasping portion that is arranged to be grasped by a user during normal lifting of the beverage container from the reference surface. The inner cup is adapted to slide upwardly relative to the outer cup to the raised position to open the communication channel when a user grasps the grasping portion during normal lifting of the beverage container from the reference surface. The beverage container will thus tend to remain affixed to the reference surface when the communication channel is closed due to the controlled pressure zone generating a partial vacuum when an attempt is made to move the beverage container without raising the inner cup. The beverage container will lift away from the reference surface without discernable resistance when the inner cup is raised to vent the controlled pressure zone to ambient pressure due to a user manipulating the grasping portion during normal lifting of the beverage container.

In a further aspect, a method is provided for consuming a beverage from a beverage container with minimal risk of spillage due container tipping. The method includes selecting a self-anchoring beverage container with directional release and attachment capability, effortlessly stabilizing the beverage container against tipping by simply placing the beverage container on the reference surface, and effortlessly releasing the beverage container by simply performing normal lifting of the beverage container using the beverage container's grasping portion.

BRIEF DESCRIPTION OF THE DRAWINGS

The foregoing and other features and advantages of the invention will be apparent from the following more particular description of various exemplary embodiments, as illustrated in the accompanying Drawings, in which.

DETAILED DESCRIPTION OF EXEMPLARY EMBODIMENTS

Introduction

Figure 1:
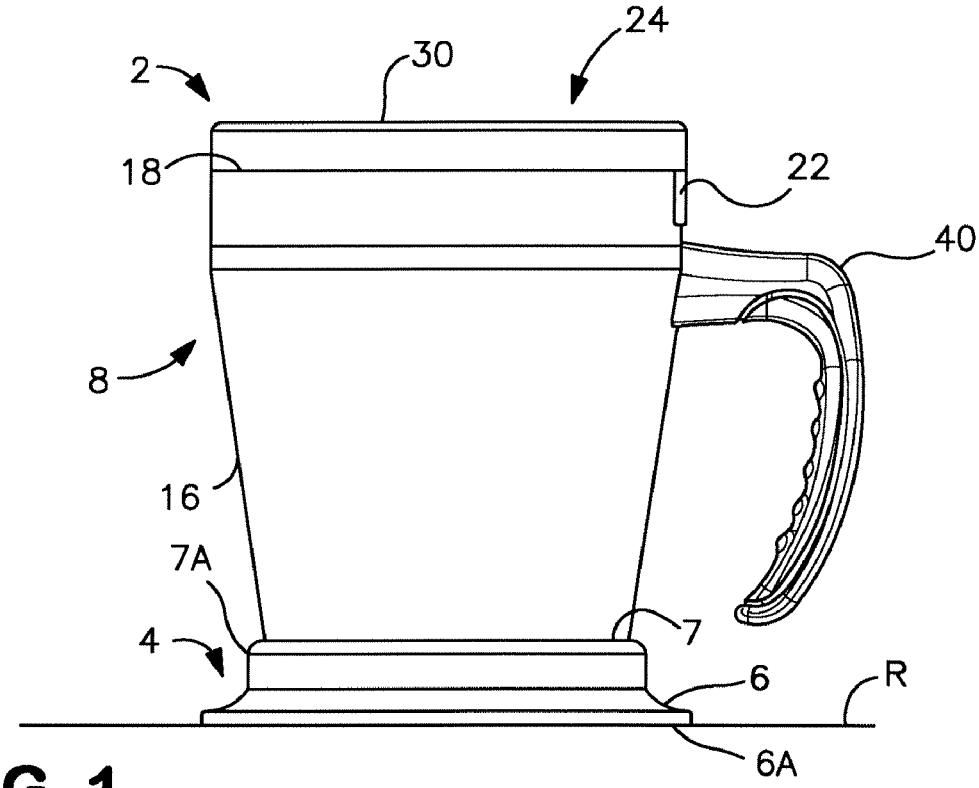
FIG. 1 is a side elevation view of an exemplary self-anchoring beverage container with directional release and attachment capability.

A self-anchoring beverage container with directional release and attachment capability as disclosed herein allows a person to partake of a beverage or other consumable in a completely normal fashion, but the container has the ability to self-anchor whenever it is placed on a reference surface, such as a table. The person using the beverage container will be completely unaware that the self-anchoring capability has been activated unless and until the beverage container experiences a force that would normally tip it over, and the user observes that the container remains upright in its normal position. The beverage container will remain self-anchored to the reference surface for as long as the user does not attempt to lift up the beverage container in a normal manner. This may be referred to as the static mode. Advantageously, the self-anchoring feature will disengage by "stealth" action as soon as the container is lifted in a normal manner. This may be referred to as the active mode. Again, the person using the beverage container will in most cases be unaware that the self-anchoring capability was ever activated or that the user is causing it to be deactivated. The beverage container will lift effortlessly from the table or other reference surface as it transitions from the static mode to the active mode and deactivation of the self-anchoring feature will be completely surreptitious and unobvious to the user. The beverage container thus provides an apparatus that if left undisturbed in the static mode is permanently biased to remain attached to a reference surface, thus preventing side load or vertical load detachments that would otherwise result in inadvertent tipping or knocking over. At the same time, the beverage container affords the user a natural single-motion use by creating a bias so that when the user lifts the apparatus up and off the reference surface, he or she does so devoid of any resistance or opposition other than the weight of the device itself.

Unlike a suction cup, which is designed to operate in a completely static environment where the intent of the user is to anchor an object so that it remains in place until the user wishes to remove it, the disclosed beverage container is adapted to be operated in a static/dynamic environment where the natural and intended use is to have the anchored container move freely in certain vector motions and remain anchored in others, so that the net result is a directionally biased attachment. In addition, although a suction cup is designed to work in any orientation, the disclosed beverage container is best used if oriented in such a way that the gravity vector is not opposing the placement of the apparatus.

The foregoing may be achieved by constructing the beverage container in two parts, namely, an upper portion that defines a mug, cup, drinking glass, bottle, carafe, bowl, bucket or other vessel made of relatively rigid material (hereinafter referred to as "rigid upper portion"), and a lower portion that is made from a flexible nonporous material (hereinafter referred to as "flexible lower portion") that works in unison with the rigid upper portion to releasably engage a reference surface. The bottom of the rigid upper portion may (if desired) be designed to transfix through the flexible lower portion flexible nonporous material so that the rigid upper portion has influence on both the environment within the flexible lower portion and above it, allowing two pressure zones to be formed. In particular, an ambient pressure zone exists above and outside of the flexible lower portion and a controlled pressure zone whose pressure tends to be lower than ambient pressure in the static mode is formed inside the flexible lower portion, i.e., between the flexible lower portion and the reference surface. In an alternative configuration, the bottom of the rigid upper portion does not need to transfix through the flexible lower portion nonporous material and instead the flexible lower portion may simply mount to the bottom of the rigid upper portion. For example, this would be the case if the flexible lower portion is configured as a traditional suction cup.

A communication channel in the rigid upper portion (and possibly in the flexible lower portion as well (e.g., if it is configured like a suction cup)) acts as a pathway between the two pressure zones (controlled and ambient). There are many options as to how the communication channel can be logistically designed into the unit. For example the communication channel may be as simple as an aperture, hole, window or other communication port located on the bottom of the rigid upper portion, to a channel that originates on the bottom of the rigid upper portion and tunnels to the side where a valve is located. Although the communication channel will often be located within the footprint of the rigid upper portion, there is nothing to prevent the channel from occupying a space separate and apart from the rigid upper portion.

A communication channel in the upper portion (and possibly in the lower portion as well (e.g., if it is configured like a suction cup)) acts as a pathway between the two pressure zones (controlled and ambient). There are many options as to how the communication channel can be logistically designed into the unit. For example the communication channel may be as simple as an aperture, hole, window or other communication port located on the bottom of the upper portion, to a channel that originates on the bottom of the upper portion and tunnels to the side where a valve is located. Although the communication channel will often be located within the footprint of the upper portion, there is nothing to prevent the channel from occupying a space separate and apart from the upper portion.

Advantageously, opening of the communication channel to effectuate transition from the static mode to the active mode is controlled by a user grasping the beverage container as part of normal lifting thereof, e.g., by grasping a handle (if present) or by grasping the beverage container at an upper side portion thereof, as one would normally pick up a cup or drinking glass. There is no need to pick up the edge of a suction cup or other suction member as is required in prior art devices. Various pressure control means may be provided for opening and closing the communication channel, most preferably a flexible nonporous blanket seal cover. Other pressure control means include but are not limited to a slider that slides up and down, a plug, stopper, or through the action of pushing or pulling out a cover door or by any other means that act to open and/or close a passageway between the controlled pressure and ambient pressure zones. This offers many advantages not only in terms of the functional benefit of allowing the design to work intuitively for the user, for example by pulling on the handle as the unit is being lifted, but also from a manufacturing perspective in that there are many options for designing and manufacturing the communication channels where tooling and production requirements dictate placement. It should also be noted that although one technique is to use mechanical means to manipulate the communication channel, alternate methods, such as electrically aided movements, could also be used.

Functionally, a person may use the beverage container like just as they would any other similar apparatus. However, the disclosed beverage container differs in that when the user places the unit on a nonporous surface any trapped air under the flexible lower portion that is attached to the rigid upper portion will be displaced, creating a partial vacuum in the controlled pressure zone that secures the container to the surface. Unlike a traditional suction cup where air must be pushed out the sides of the suction cup by way of an affirmative intentional action by the user, the disclosed beverage container does not require such user-intended action. Instead, it vents the controlled pressure zone through the communication channel, which can be configured to remain open until the flexible lower portion is partially flattened onto the reference surface by the weight of the rigid upper portion, at which point the user may terminate the active mode and initiate the static mode by the simple expedient of releasing the beverage container in normal fashion. Because the flexible lower and rigid upper portions are attached to each other, the anchored beverage container will be anchored to the reference surface in the static mode and resist tipping over and spilling. When the user wants to lift the apparatus he/she can simply lift the beverage container in a natural and instinctive upward movement. This opens the communication channel between the ambient pressure zone situated above and outside the flexible lower portion and the lower pressure area that exists in the controlled pressure zone below the upper portion that is created by the flexible lower portion. The results is in an almost instantaneous and complete equalization of pressure so that no residual suction remains, thereby allowing the user to lift the apparatus with no opposition (other than its weight). The net result is an integrated system that both engages and disengages during the normal course of use so that the beverage container operates in an intuitive and stealth-like manner. There is no need to twist, lift or otherwise directly manipulate the lower portionflexible lower portion. This results in a more stable and reliable method for removal and equalization of pressure than is provided by apparatus requiring the user to affirmatively release a suction, as by peeling up an edge of a suction cup. In addition, the user can lower the apparatus down and reaffix it in a predictable and reliable manner.

Exemplary Embodiments

Figure 2:
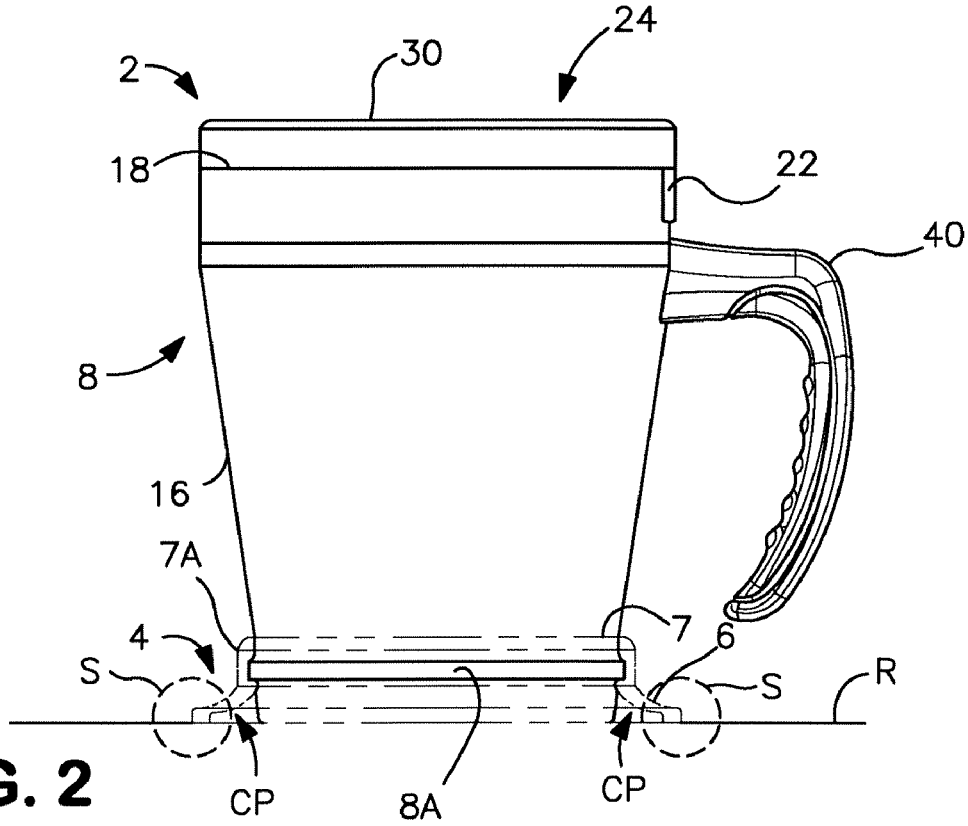
FIG. 2 is a side elevation view of the beverage container of FIG. 1 with a base member thereof being shown in phantom line representation.
Figure 3:
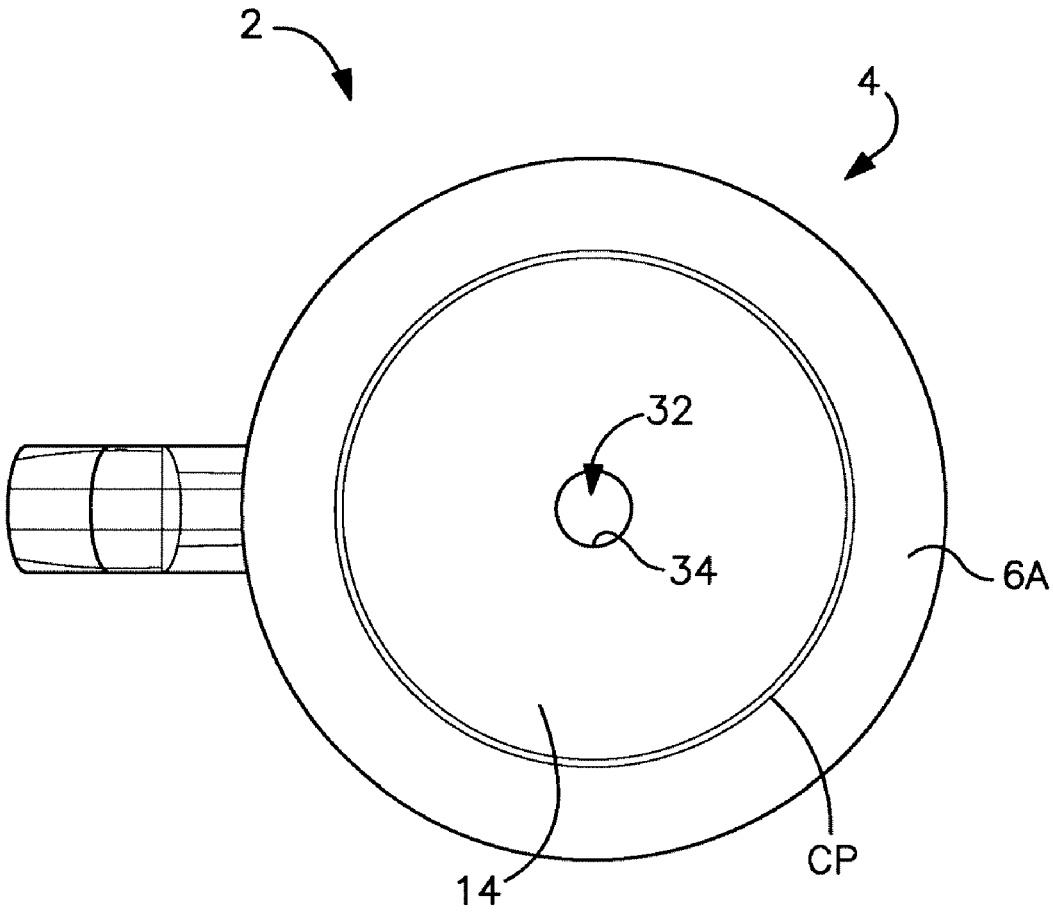
FIG. 3 is a bottom view of the beverage container of FIG. 1.

Turning now to the drawing figures, wherein like reference numerals represent like elements in all of the several views, FIGS. 1-3 illustrate one possible embodiment of a self-anchoring beverage container 2 with directional release and attachment capability. The beverage container 2 is configured, by way of example only, as a mug for drinking hot beverages such as coffee, tea or the like. Other types of beverage containers, such as cups, drinking glasses, bottles, carafes, bowls, buckets and the like may also be implemented. Such containers represent vessels that may be used for holding a variety of liquids, solids or combinations thereof.

The beverage container 2 includes a flexible nonporous base member 4 having a lower peripheral skirt 6 whose lower surface 6A is configured to engage an external reference surface R, such as a table, and form a substantially airtight seal S therewith that defines the periphery of a controlled pressure zone CP between the beverage container 2 and the reference surface R. The base member 4 can be made from silicone rubber, neoprene foam rubber or any other suitable material capable of forming a seal. Neoprene foams that are advantageous include those in which at least one side of the foam layer has an air impervious skin that provides a nonporous characteristic. If the air impervious skin is only on one side of the foam layer, this side will be used to provide the seal-forming lower surface 6A that engages the reference surface R. In general, the base member 4 may have any desired degree of flexibility, according to design preferences, and any suitable configuration. Exemplary configurations are described in more detail below in connection with FIGS. 11-21.

The base member 4 includes a central aperture 7 that allows the base member to be mounted to a receptacle assembly 8. For stability, the bottom of the receptacle assembly 8 will preferably be able to rest on the reference surface R when the base member 4 is affixed to the reference surface. However, this is not a requirement in all cases and the bottom of the receptacle assembly 8 could be suspended above the reference surface R if so desired. Note that allowing the receptacle assembly 8 to rest on the reference surface R does not affect the controlled pressure zone CP. For added stability, the controlled pressure zone CP preferably extends outside of the foot print of a lower sidewall portion of the receptacle assembly 8. As can be seen in FIG. 2, even when the receptacle assembly 8 sits on the reference surface R, there will still be an air pocket located between a lower outside edge of the receptacle assembly 8 and an uppermost portion of the base member's peripheral skirt 6. Moreover, if an attempt is made to lift the beverage container 2 while the base member 4 is affixed to the reference surface R, the flexibility of the base member will allow it to stretch so that the receptacle assembly 8 will be slightly raised from the reference surface. This will form an air gap directly underneath the bottom of the receptacle assembly that becomes part of the controlled pressure zone CP. As described in more detail below, this added volume will decrease the pressure within the controlled pressure zone CP, causing the suction force that holds the beverage container 2 to proportionately increase in accordance with Boyle's law.

The mounting between the base member 4 and the receptacle assembly 8 may be permanent, or it may be temporary so that the base member 4 can be removed for cleaning or replacement. If a permanent mounting arrangement is used, the base member 4 may be connected to the receptacle assembly's central aperture 7 by way of glue, fasteners, clamps or other suitable means that will insure a permanent and secure attachment. If a temporary mounting arrangement is desired, the base member's central aperture 7 can be sized so that it needs to be stretched in order to receive the receptacle assembly 8, thereby providing a snug fit that will not loosen during normal use of the beverage container or when tipping forces are applied thereto. Although the temporary mounting arrangement allows the base member 4 to be detached from the receptacle assembly 8 for cleaning and the like, these components preferably work in unison during operation of the beverage container 2, and need not be interchangeable with other generic components (although they could be if so desired). As described in more detail below in connection with FIGS. 11-20, one way that a tight yet detachable mounting arrangement can be provided is to flip up the portion of the base member 4 that proximately surrounds the aperture 7 in order to form a lip 7A whose inner surface seals to a matching outer surface portion 8A (FIG. 2) of the receptacle assembly 8. As shown in FIG. 2, the surface portion 8A may be channeled to receive corresponding ribs formed on the inner surface of the lip 7A.

Figure 4:
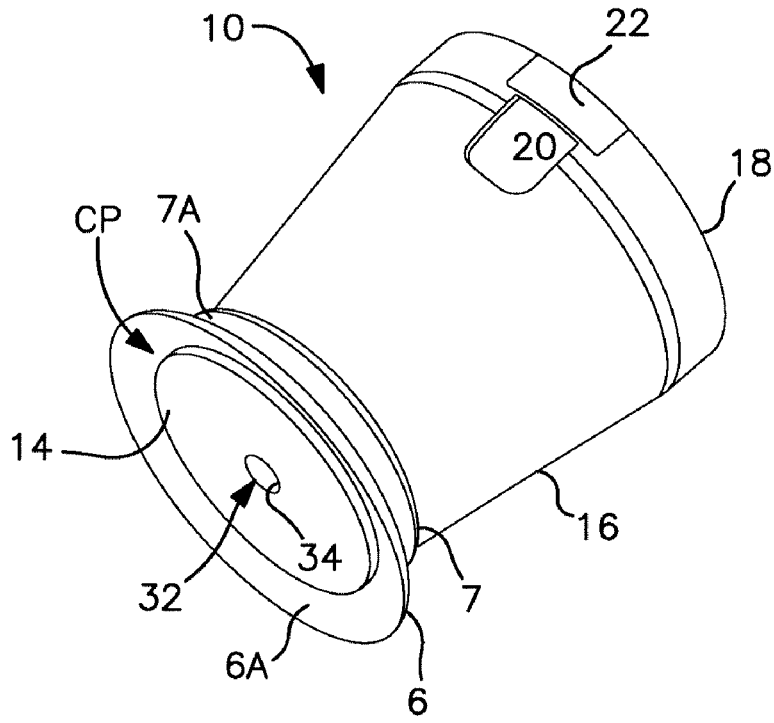
FIG. 4 is a perspective view showing the exterior of an exemplary outer cup of the beverage container of FIG. 1.
Figure 5:
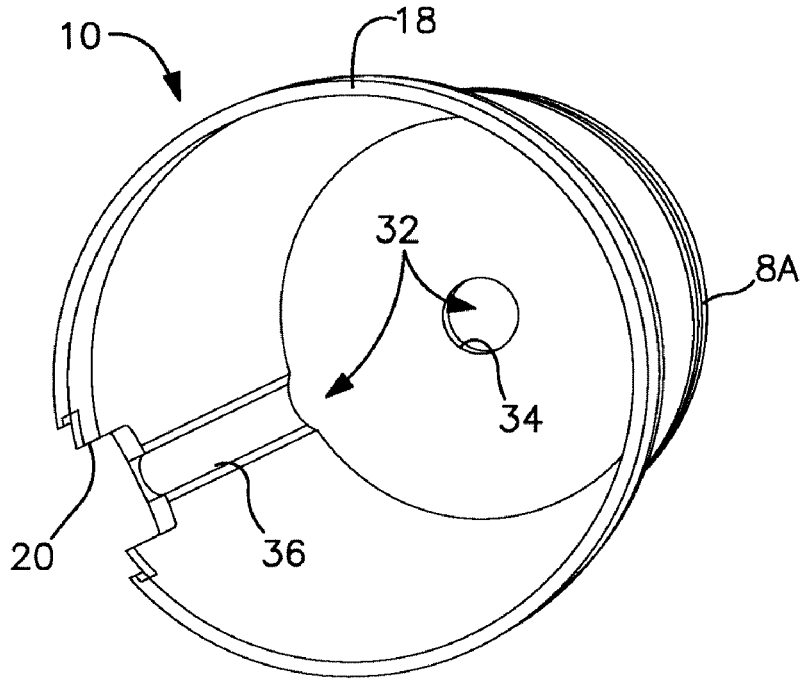
FIG. 5 is a perspective view showing the interior of the outer cup of FIG. 4.
Figure 6:
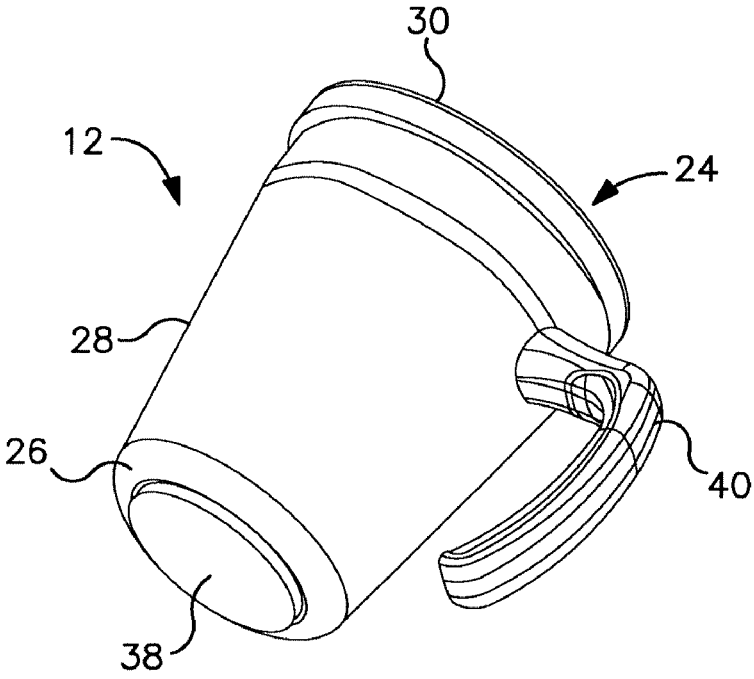
FIG. 6 is a perspective view showing an exemplary inner cup of the beverage container of FIG. 1.

As respectively shown in FIGS. 4-5 and 6, the receptacle assembly 8 may be constructed as a two-part assembly that includes an outer cup 10 and an inner cup 12 slideably disposed within the interior of the outer cup. These components can be made from a durable rigid plastic or other suitable material that is relatively non-flexible, including but not limited to glass, ceramic, and metal. Combinations of the foregoing materials may also be used. The outer cup 10 can be configured as a carrier having a bottom 14, a sidewall portion 16 and an open top 18. The sidewall portion 16 is formed with a slot 20 that extends to the top 18. A stop member 22 can be attached during fabrication of the receptacle assembly 8 via ultrasonic welding or other suitable attachment means so as to bridge the upper portion of the slot 20 at the top 18. The stop member 22 provides a coupling that retains the inner cup 12 and limits its slideable movement relative to the outer cup 10, preferably to not more than approximately 1 cm. Other forms of coupling could also be used.

The inner cup 12 can be configured as a vessel that comprises a beverage holding chamber 24 having a closed bottom 26, a sidewall portion 28, and an open (or partially open) top 30. The outer cup 10 is sized so that the outer cup sidewall 16 snuggly engages the inner cup sidewall 28 in order to minimize rocking of the inner cup relative to the outer cup. Alternatively, an air gap could be maintained between the outer cup 10 and the inner cup 12 to help insulate a beverage within the inner cup. This will also allow the outer cup 10 to act as a coaster that prevents condensation from dripping onto the supporting reference surface R. The top 18 of the outer cup 10 extends above the inner cup 12 when the outer cup is in its lowest position. The amount of the outer cup 10 that is exposed above the inner cup 12 is a matter of design choice. In the present embodiment, the outer cup 10 is sized to substantially overlap the inner cup 12. However, as described in more detail below in connection with an alternative embodiment, the outer cup 10 could be substantially shorter so as to cover, for example, less than half of the inner cup sidewall portion 28. It will be appreciated that the outer cup 10 and the inner cup 12 may be of any desired height, width and cross-sectional shape. For example, these components could be tall and narrow, short and wide, and of circular, oval, square or other cross-sectional configuration.

Figure 7:
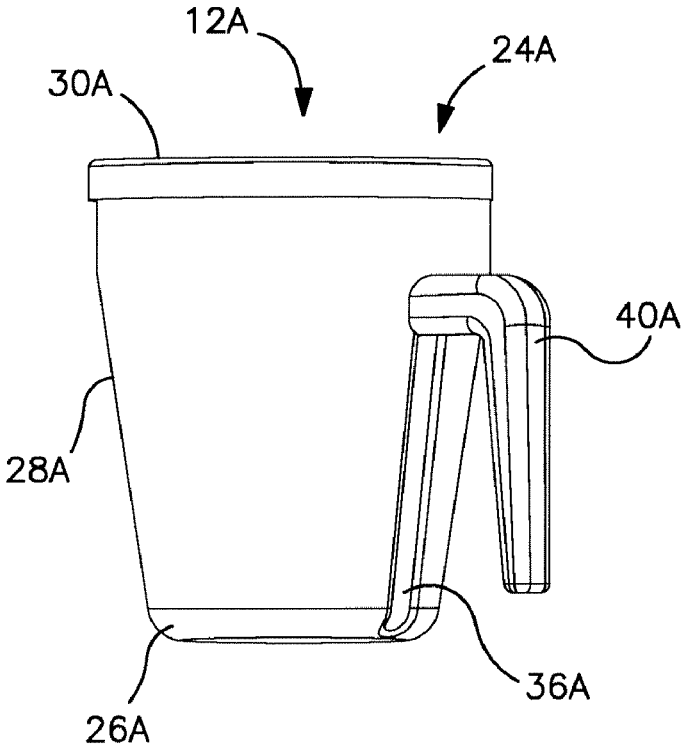
FIG. 7 is a perspective view of another exemplary inner cup showing an optional vent channel formed therein.
Figure 8:
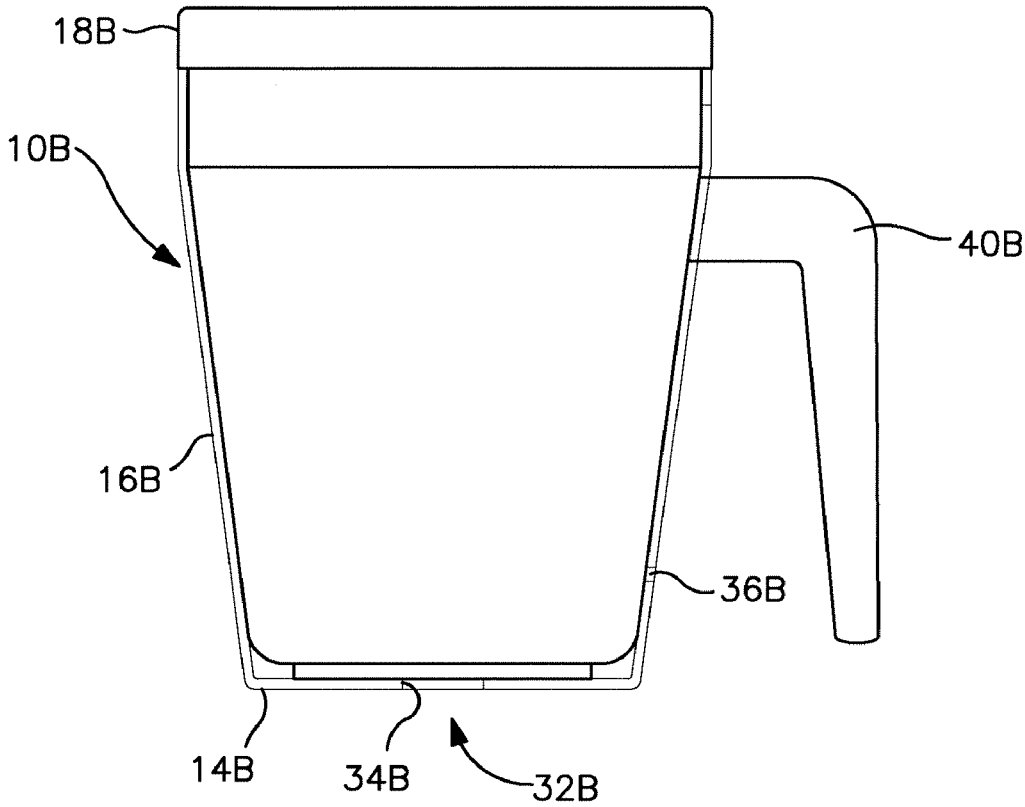
FIG. 8 is a side elevational view showing another exemplary self-anchoring beverage container with directional release and attachment capability in which an outer cup is shown in phantom line representation to receive an inner cup and wherein the outer cup is formed with optional vent apertures.
Figure 9:
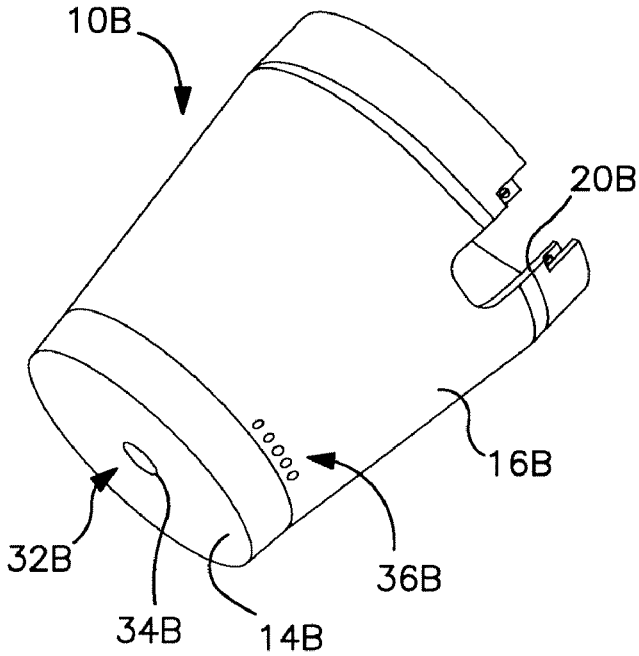
FIG. 9 is a perspective view showing the outer cup of FIG. 8.

As best shown in FIGS. 3-5, a communication channel 32 extends from the controlled pressure zone CP, which is on the lower side of the outer cup bottom 14, to an area of ambient air pressure that is represented by the environment outside of the controlled pressure zone CP. The communication channel 32 may be provided by a central communication port 34 and an optional side wall vent channel 36 formed in the outer cup 10. Alternatively, as shown in FIG. 7, a modified inner cup 12A may be provided that is similar to the inner cup 12 but is formed with an optional sidewall vent channel 36A. A still further alternative may be provided by a modified outer cup 10B as shown in FIGS. 8 and 9. The modified outer cup 10B is similar to the outer cup 10 but is formed with one or more optional vent apertures 36B on the outer cup sidewall 16B.

As shown in FIG. 6, a pressure control device can be implemented by way of a blanket seal 38 made from neoprene or other suitable seal material that mounts to the bottom 26 of the inner cup 12. The seal 38 is adapted to sealably close the communication port 34 in the outer cup 10. It should be at least as large as the communication port 34 and is preferably substantially larger in order provide a more forgiving seal that does not require precise alignment with the communication port in order to function. For example, if the communication port 34 is one-half inch in diameter, the seal 38 should have a diameter of at least slightly more than one-half inch if it is to function as a blanket seal and not a plug seal. In FIG. 6, the seal 38 covers the entire flat portion of the inner cup bottom 26, a diameter of about one inch, and is therefore twice as large as a one-half inch communication port 34. The seal 38 can be attached to the bottom 26 of the inner cup 12 in any suitable fashion, such as by using an adhesive. Preferably, a substantial portion of the seal 38, or at least the portion thereof that covers the communication port 34, will be attached. This will prevent any localized distortion and pulling away of the seal 38 from the inner cup bottom 26 when a user lifts the inner cup 12 and creates a suction force on the seal due to the lower pressure in the controlled pressure zone CP.

Because the seal 38 is mounted to the inner cup 12, and the inner cup is slideably disposed within the outer cup 10, the pressure control device will have a closed static mode position that closes the communication channel 32 and seals the controlled pressure zone CP, and an open active mode position that opens the communication channel to vent the controlled pressure zone to ambient pressure. The closed and opened positions of the pressure control device are respectively shown in FIGS. 10A and 10B. The downwardly extending arrows show the equalizing air flow that occurs within the communication channel 32 when the pressure control device is opened due to upward displacement of the inner cup 12 relative to the outer cup 10. The arrows point downward because the equalizing air flow is from the higher pressure ambient atmosphere outside the controlled pressure zone CP to the lower pressure area within the controlled pressure zone.

As shown in FIGS. 1-2, 6 and 10A-10B, a grasping portion on the receptacle assembly 8 can be implemented by way of a handle 40 on the inner cup 12. Alternatively, if desired, the portion of the inner cup 12 that extends above the top 18 of the outer cup 10 (i.e., the region adjacent to the inner cup top 30), could also serve as a grasping portion of the receptacle assembly 8. In this way, the handle 40 could be dispensed with and the beverage container 2 could be configured as a glass. In either case, the grasping portion is arranged to be grasped by a user during normal lifting of the beverage container 2 from the reference surface R. Due to the attachment of the seal 38 to the inner cup 12, the pressure control device is operatively connected to the grasping portion for actuation to the open position when a user grasps the grasping portion (which is also part of the inner cup) during normal lifting of the beverage container 2 from the reference surface R. This normal lifting will raise the inner cup 12 from its lowered position shown in FIG. 10A to its raised position shown in FIG. 10B, causing the seal 38 to separate from the communication port 34, thereby opening the communication channel 32 and venting the controlled pressure zone (via the sidewall vent channel 36 if present) to atmosphere.

So long as the reference surface R is not substantially vertical or at an angle that is greater than 90 degrees (e.g. it is not a wall, window or ceiling), gravitational force will tend to maintain the inner cup 12 in its lowered position when the beverage container 2 is resting on the reference surface in the static mode. The pressure control device will be closed due to the seal 38 covering the communication port 34 of the communication channel 32, and the controlled pressure zone CP will be closed. In this way, the beverage container 2 will be self-biased to remain affixed to the reference surface R when the communication channel 32 is closed. This affixation to the reference surface R is due to the controlled pressure zone generating a partial vacuum when an attempt is made to move the beverage container 2 without actuating the pressure control device. In particular, any attempted lifting, tipping or twisting of the beverage container 2 with the pressure control device in the closed position will tend to increase the volume of the controlled pressure zone CP due to distortion of the flexible base member 4. As the volume of the controlled pressure zone CP increases, the air pressure therein drops in reciprocal fashion according to Boyle's law, thereby increasing both the sealing force that affixes the beverage container 2 to the reference surface R and the sealing force of the seal 38 on the communication port 34. On the other hand, the self-biasing of the beverage container 2 will be released surreptitiously and the beverage container will lift away from the reference surface R without discernable resistance when the pressure control device is actuated in the active mode to vent the controlled pressure zone CP due to the user manipulating the grasping portion during normal lifting of the beverage container. From the user's perspective, there will be no apparent anchoring force on the beverage container 2 and it will feel as if the base member 4 and the controlled pressure zone CP were not present. The inner cup 12 can be easily raised and doing so immediately separates the seal 38 from the communication port. By the time the inner cup 12 reaches its raised position shown in FIG. 10B, the communication channel 32 will have been fully opened to vent the controlled pressure zone CP, thereby eliminating the affixing effect on the beverage container 2 and allowing the user to continue raising the inner cup 12, and with it the remainder of the beverage container 2.

Figure 10A:
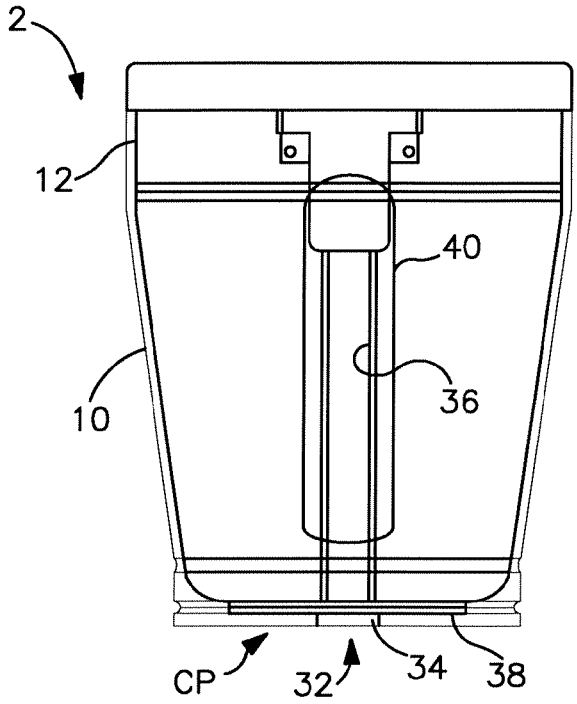
FIG. 10A is side elevation view showing a phantom line representation of the outer cup of FIGS. 4-5 with the inner cup of FIG. 6 in a lowered position.
Figure 10B:
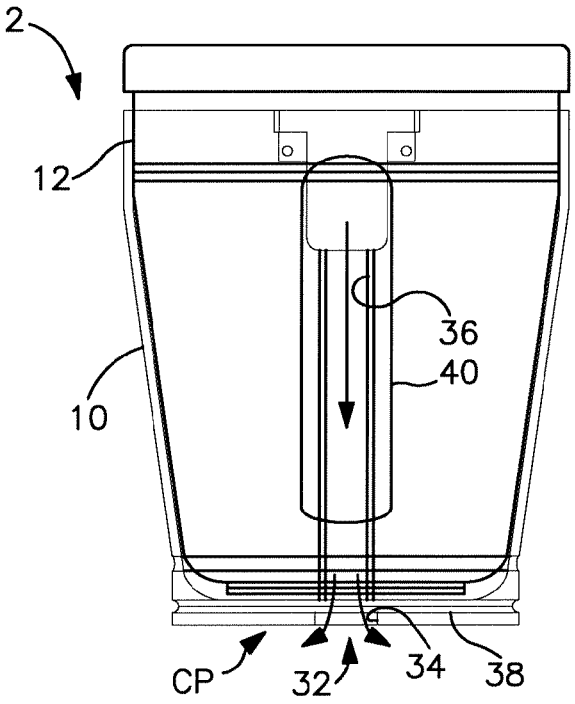
FIG. 10B is side elevation view showing a phantom line representation of the outer cup of FIGS. 4-5 with the inner cup of FIG. 6 in a raised position.

When lowering the beverage container 2, the base member 4 and the outer cup 10 will contact the reference surface R while the inner cup 12 is still in the raised position shown in FIG. 10B. The communication channel 32 will still be fully open and will remain open until the inner cup 12 is fully lowered to its FIG. 10A position. Before the inner cup 12 begins to move from the raised position of FIG. 10B to the lowered position of FIG. 10A, the base member 4, which is now in contact with the reference surface R, will partially collapse under the weight of the receptacle assembly 8 until the outer portion of the base member peripheral skirt 6 is substantially flat. Advantageously, the open communication channel 32 will serve as a vent for air as it is evacuated from the controlled pressure zone CP during the partial collapse of the base member 4. Only when the inner cup 12 has reached it fully lowered position as shown in FIG. 10A will the communication port 34 be covered by the blanket seal 38 and the communication channel 32 closed. This contributes to the stealth operation of the beverage container 2 because no downward force is required to expel air out the sides of the peripheral skirt 6, as would be required in order to seal a traditional suction cup.

As a consequence of anticipating that the beverage container 2 will be exclusively used in an environment that works in concert with the downward influence of gravity (insofar as a fluid contained in the upper portion would certainly flow out at any angle of substantially ninety degrees or greater from a horizontal plane) there is the opportunity to use the unique blanket type seal 38 as a communication port gate keeper and a means for opening and closing communication between the controlled pressure zone CP and the ambient pressure zone located above and outside of the base member 4. This unique design is effective in achieving the stealth and intuitive active mode operation of the beverage container 2 in that the blanket seal provides a very simple means for segregating or controlling air flow communication between the two pressure zones (controlled and ambient) without relying on friction or any other oppositional means during the seal's operation. The user can operate this communication gate keeper between pressure zones devoid of the need to overcome any frictional opposition, as would be present using any plug or cap, thus insuring a smooth and easier operation. In addition, using a blanket seal insures that the communication port 34 will remain immune from environmental interference such as moisture, temperature change and simple wear and tear that could influence the fit and operation between the communication port and a plug or cap seal that operates on the theory of maintaining a specific tolerance or clearance between two parts. In its preferred implementation, the blanket seal 38 simply overwhelms the open communication port 34 by virtue of the seal being larger then the cross-sectional size of the communication port and by the inherent flexible quality of the material of the blanket being able to form and adjust over the port.

The net result is a more consistent and invisible method of communication between the controlled and ambient pressure zones. In addition, because the blanket seal 38 does not need to be the same size as the communication port 34, and in fact is likely to be significantly larger then the open port, the seal compensates for any differential tolerances that might exist between any moving parts. For example, should there be an play between the sidewall portions of the inner cup 10 and the outer cup 12 that results in misalignment between the seal 38 and the communication port 34, the controlled pressure zone CP will still be sealed because the seal is large enough to blanket the entire port. Thus, in addition to the stealth benefits of the blanket seal 38, it can also compensate for the orientation of the reference surface R and any differences that might occur in how the operator places the unit down in the static mode. Even if the reference surface R is angled at a thirty degree angle (or more) the blanket seal 38 will still have no problem covering the communication port 38 when required and the seal will be consistent and compensating. This may not be the case in situations where there is a need to "thread the needle," such as in a cap or seal where it is imperative and anticipated that the two mating parts come together exactly the same way and in the same place every time in order to work, and where even a slight variation in mating positions would result in something less than a perfect seal.

Figure 11:
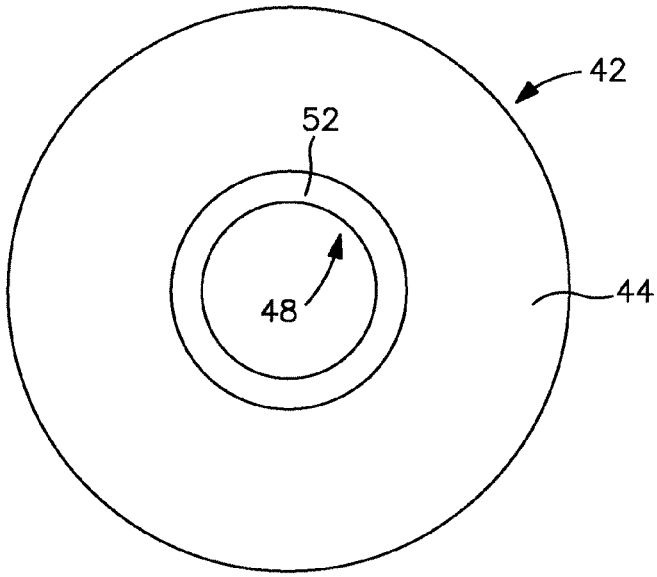
FIG. 11 is a plan view of an exemplary seal member in its unmounted configuration.
Figure 12:
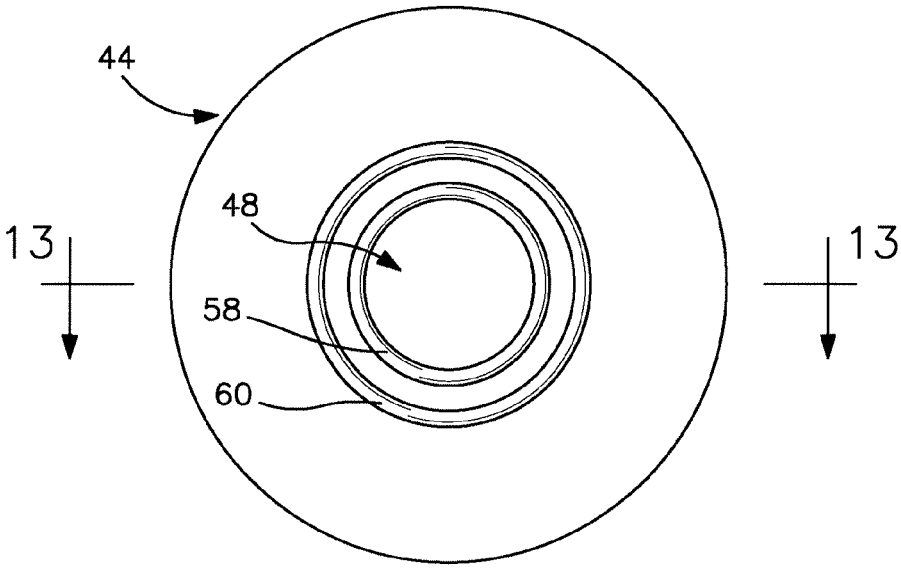
FIG. 12 is a bottom view of the seal member of FIG. 11 in its unmounted configuration.
Figure 13:
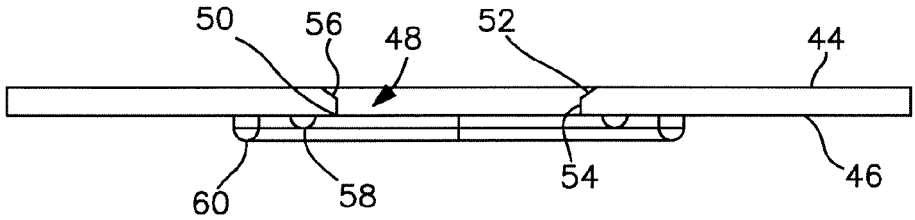
FIG. 13 is a cross-sectional centerline view taken along line 13-13 in FIG. 12.

The base member 4 can be constructed in accordance with a number of different designs. For example, as shown in FIGS. 11-13, the base member 4 can be implemented as a nonporous seal member 42 having a disk shape or other suitable configuration made from a generally planar material sheet. The seal member 42 has an upper surface 44 and a lower surface 46 (FIG. 13). Again, the seal member 42 may be formed from a variety of flexible nonporous materials, including neoprene foam, so long as at least the lower surface 46 is nonporous. A central opening 48 extends through the seal member 42 from the upper surface 44 to the lower surface 46. The central opening 48 has a sidewall 50. A chamfer 52 on the upper surface 44 extends outwardly from a lower portion 54 of the central opening 48 such that the central opening sidewall 50 includes a tapered surface 56 defined by the chamfer.

As shown in FIGS. 12 and 13, one or more ribs 58 and 60 may be formed on the lower surface 46 proximate to the central opening 48. If desired, the inner rib 58 can be shorter in height than the outer rib 60. Although the ribs 58 and 60 are each shown as being circular, continuous and of constant height, they could also be non-circular, non-continuous and of varying height.

Figure 14:
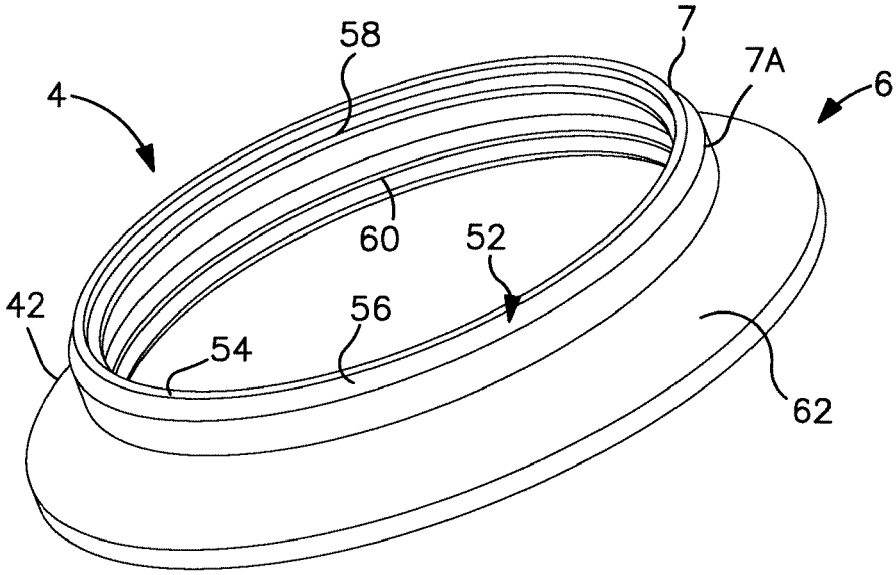
FIG. 14 a perspective view of the seal member of FIG. 11 in its mounted configuration.
Figure 15:
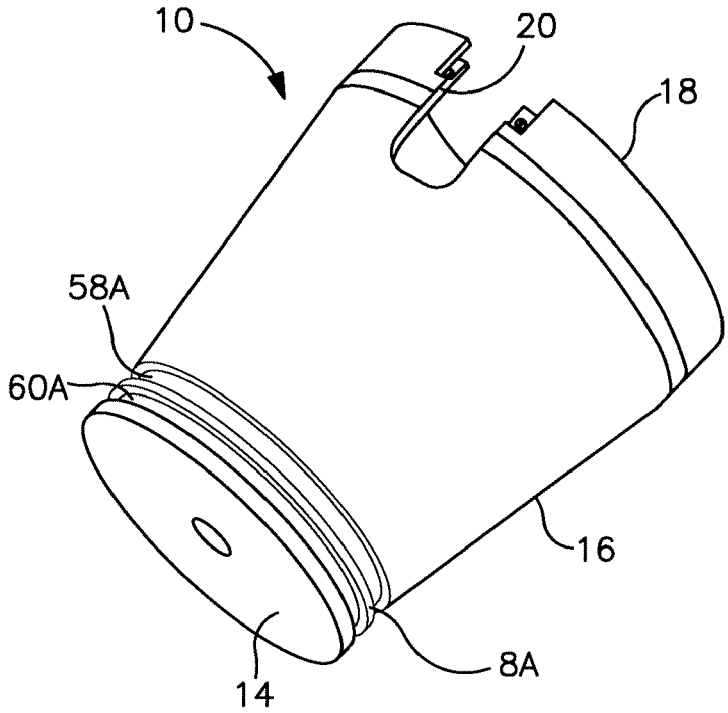
FIG. 15 is a perspective view of the outer cup of FIGS. 4-5 prior to receiving the seal member configured as shown in FIG. 14.

As shown in FIGS. 14 and 15, in order to utilize the seal member 42 as the base member 4 of the beverage container 2, the portion thereof that is proximate to the central opening 48, and which includes the ribs 58 and 60, is stretched and flipped upwardly while the seal member 42 is being mounted on the surface portion 8A of the outer cup 10. This flipping operation causes the previously discussed aperture 7 and lip 7A to be formed. Alternatively, instead of starting with the disk-shaped seal member 42, the seal shape shown in FIG. 14 could be achieved by molding or otherwise pre-forming a seal material, such as silicone rubber, into the final desired shape. The inner surface of the lip 7A, which is defined by the lower surface 46 of the seal member 42, is capable of sealing to the outer cup 10 in the same way that the lower surface 6A of the base member 4 seals to the reference surface R to create the controlled pressure zone CP. Any force tending to pull the lip 7A away from the outer cup 10 will tend to create a low pressure zone between the outer cup and the lip inner surface that produces a suction force. Correct registration of these components will be assured by virtue of the ribs 58 and 60 respectively engaging corresponding channels 58A and 60A formed in the outer cup's surface portion 8A. In this position, the inner rib 58 also forms a ring seal that seals to the upper channel 58A of the outer cup 10 and the outer rib 60 forms a secondary seal that seals to the outer cup's lower channel 60A. A tertiary seal will be formed between the seal member 42 and the outer cup 10 in the region between the inner and outer ribs 58 and 60. It will also be seen in FIG. 14 that the tapered surface 56 defined by the chamfer 52 at the seal member's central opening 48 will face generally outwardly away from the outer cup 10, providing a streamlined appearance. The lower portion 54 of the central opening 48 will face upwardly. The foregoing deformation of the seal member 42 will also result in the formation of a peripheral skirt 62 that extends radially outwardly from the lip 7A. This provides the peripheral skirt 6 of FIG. 1. The portion of the seal member lower surface 46 that resides in the region of the skirt 62 will provide the seal-forming lower surface 6A of the base member 4, as described above in connection with FIGS. 1-3.

Figure 16:
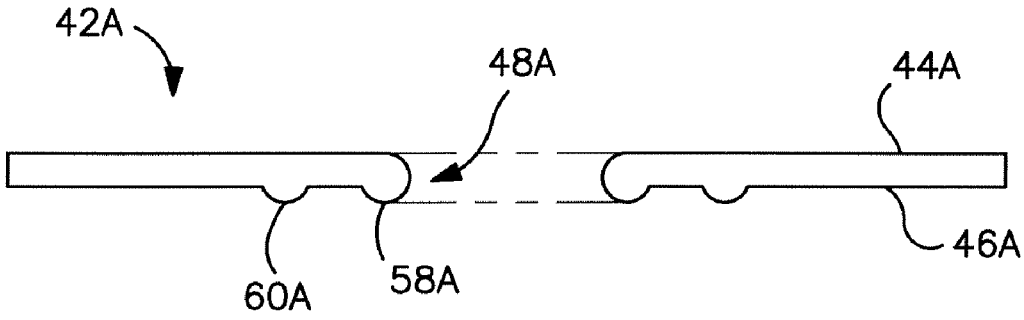
FIG. 16 is a cross-sectional centerline view of another exemplary seal member in its unmounted configuration.

Turning now to FIG. 16, a modified version 42A of the seal member 42 is shown. In this seal member version, the innermost rib 58A is situated at the central opening 48A, such that the central opening sidewall 50A is continuously curved.

Figure 17:
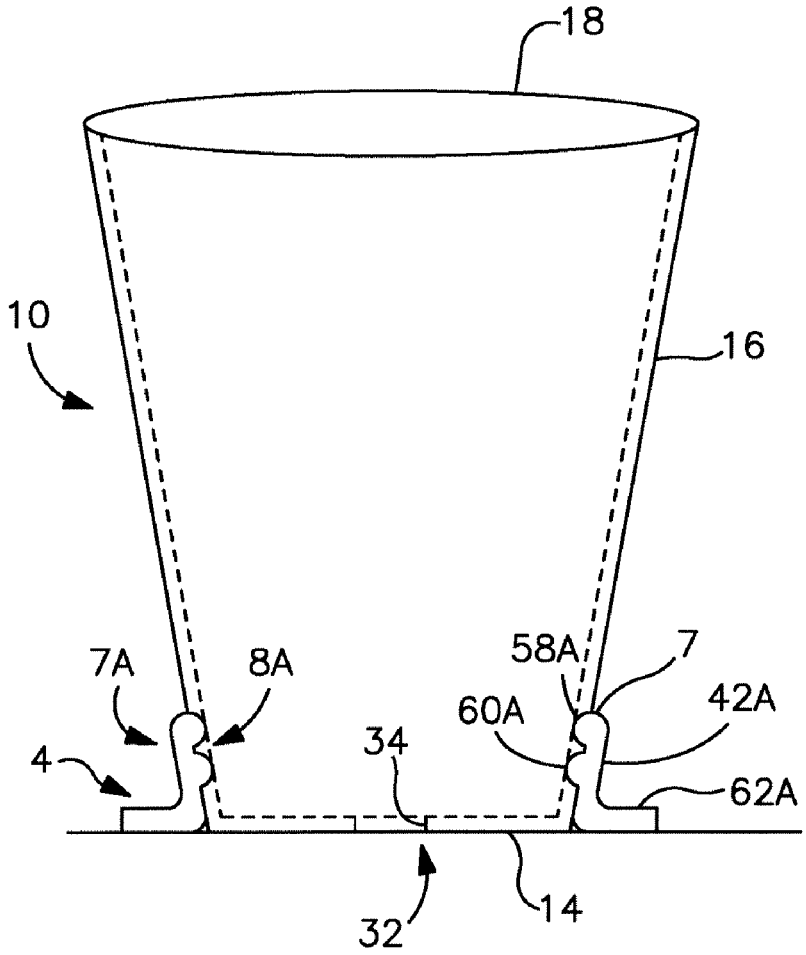
FIG. 17 is a cross-sectional centerline view of the seal member of FIG. 16 mounted on an exemplary beverage container outer cup.

FIG. 17 illustrates the seal member 42A after it has been mounted on the outer cup 10 (shown diagrammatically) to form the base member 4. The aperture 7 and the lip 7A are formed and mounted to the surface portion 8A of the outer cup 10. A skirt 62A is also formed and provides the peripheral skirt 6 and the seal-forming lower surface 6A of FIG. 1.

Figure 18:
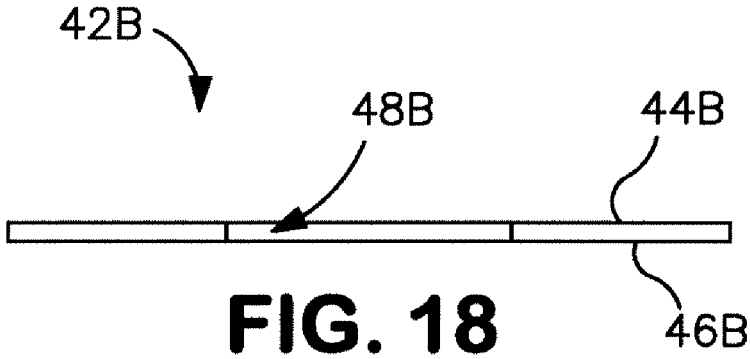
FIG. 18 is a cross-sectional centerline view of another exemplary seal member in its unmounted configuration.
Figure 19:
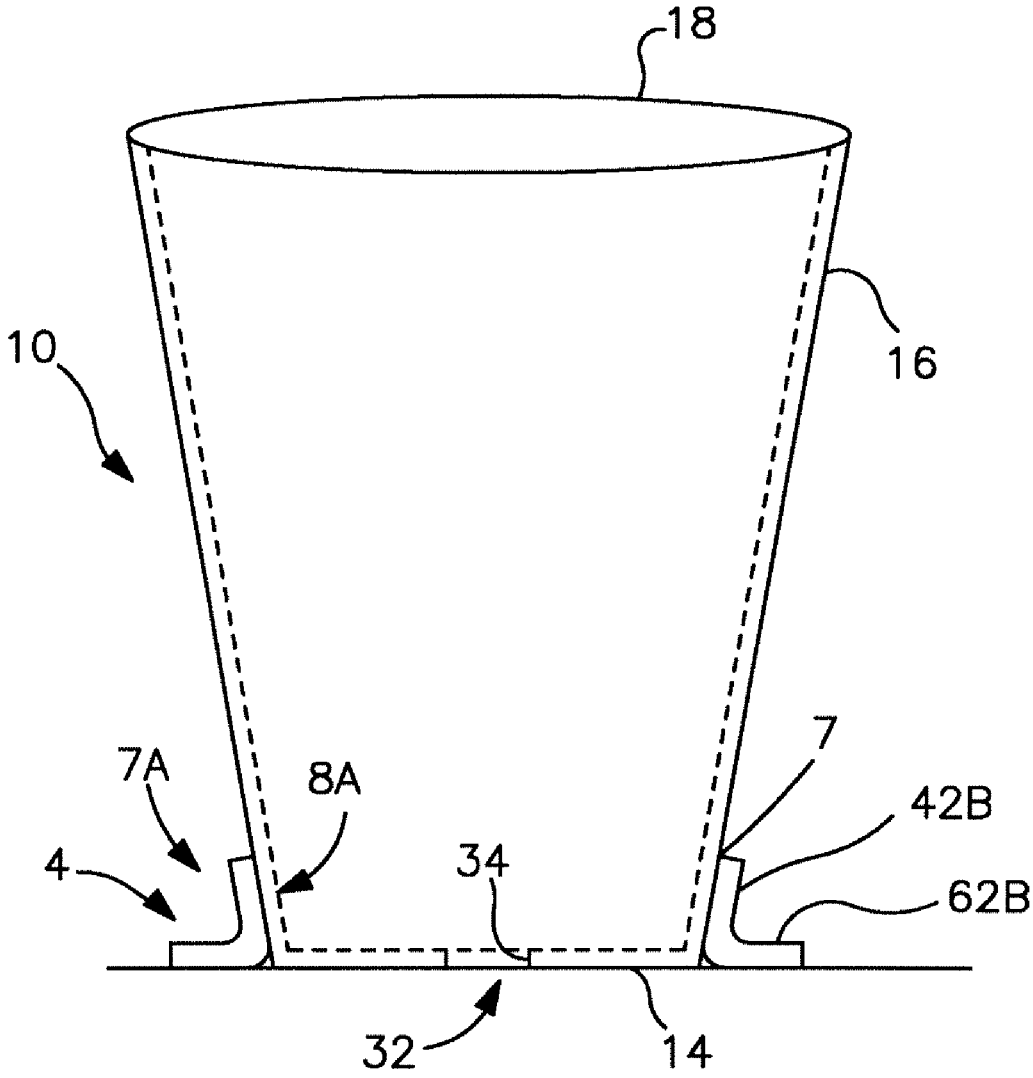
FIG. 19 is a cross-sectional centerline view of the seal member of FIG. 19 mounted on an exemplary beverage container outer cup.

Turning now to FIGS. 18 and 19, a further modified version 42B of the seal member 42 is shown. In this version, the chamfer and the ribs are eliminated such that the seal member 42B comprises nothing more than a flexible nonporous washer having an upper surface 44B, a lower surface 46B and a central opening 48B of substantially uniform cross-section. Washers of this type made from rubber have been used for plumbing and other applications for probably one hundred years or more, yet can be used to form the base member 4 if the washer is thin and flexible enough to flip up and form the aperture 7 and the lip 7A that engage the surface portion 8A of the outer cup 10, which is shown diagrammatically in FIG. 20. If the washer outside diameter is large enough relative to the diameter of the central opening 48B, a skirt 62B will be formed that provides the peripheral seal 6 and the seal-forming lower surface 6. Neoprene or other flexible nonporous materials may also be used to form the seal member 42B.

Figure 20:
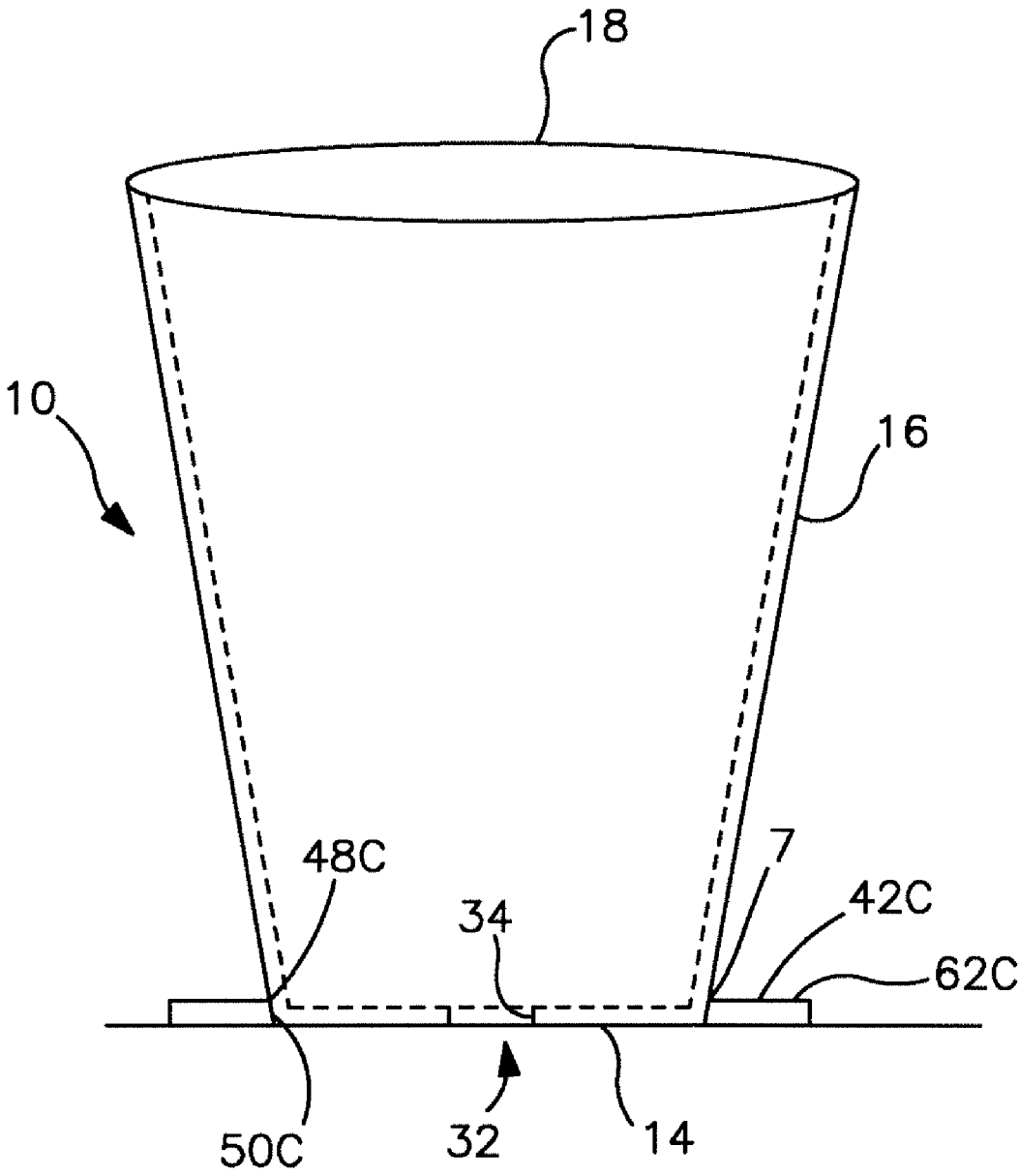
FIG. 20 is a cross-sectional centerline view of another exemplary seal member mounted on an exemplary beverage container outer cup.

FIG. 20 shows a further modified seal member 42C that can also be formed from a conventional rubber washer (or a washer made of other flexible nonporous material), but the seal member's central opening aperture 48C is shaped and sized to substantially match the shape and size of the outer cup sidewall 16, to which is it attached. In this way, the central aperture 7 for mounting the seal member 42C to the outer cup 10 does not need to flipped up to form the lip 7A shown in previous seal member embodiments. Nor is it the bottom surface of the seal member 42C that provides the central aperture 7. Instead, it is the sidewall 50C of the central opening 48C that engages the outer cup sidewall 16. This attachment is secured using an adhesive or other suitable means to prevent the seal member 42C from becoming dislodged. The portion of the seal member 42C that extends radially outwardly from the central aperture 7 forms a peripheral skirt 62C.

Figure 21:
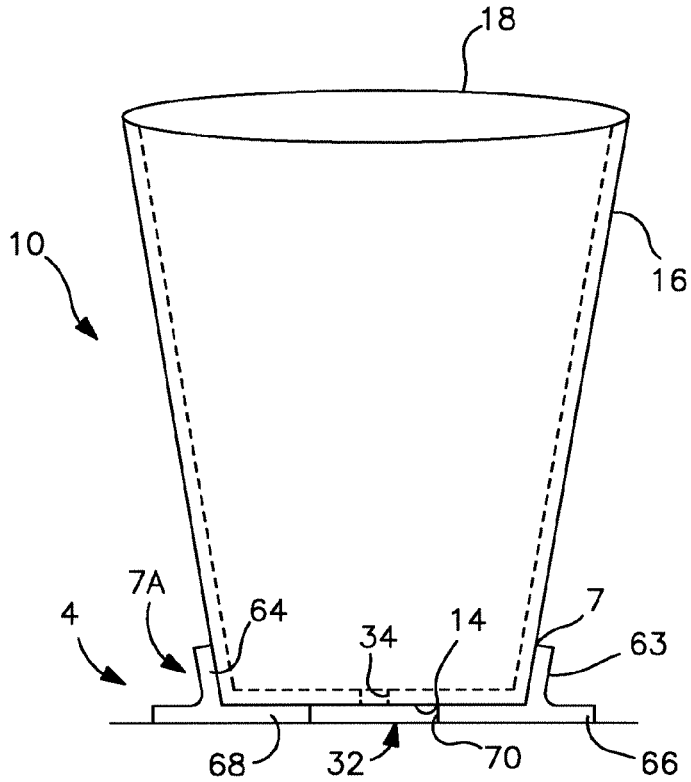
FIG. 21 is a cross-sectional centerline view of another exemplary seal member mounted on an exemplary beverage container outer cup.

Turning now to FIG. 21, a further exemplary seal member 63 is shown that is not formed from a generally planar material sheet but is instead pre-formed substantially into its final mounting configuration. Thus, the seal member 63 is fabricated with a pre-formed lip structure 64 that defines the aperture 7 and the lip 7A of the base member 4. A skirt structure 66 is also formed that extends radially outwardly from the lip structure 64. An inner portion 68 is likewise formed on the seal member 63. The inner portion 68 covers at least a portion of the bottom 14 of the outer cup 10 (which is shown diagrammatically in FIG. 21). A central aperture 70 is provided in the inner portion 68 that lines up with the outer cup's communication port 34 and provides part of the communication channel 32. Although the central aperture 70 is shown in FIG. 21 as being larger than the communication port 34, it could be the same size or even smaller than the communication port.

Figure 22:
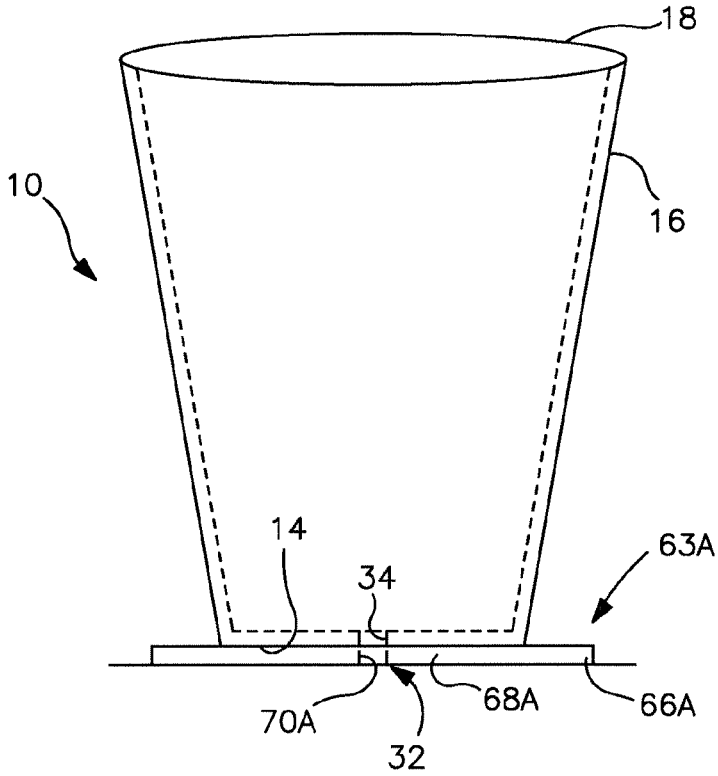
FIG. 22 is a cross-sectional centerline view of another exemplary seal member mounted on an exemplary beverage container outer cup.

FIG. 22 shows a modified version 63A of the seal member 63 of FIG. 21 in which the lip structure 64 is eliminated. Instead, the seal member 63A has an inner portion 68A that is attached via an adhesive or other means to the bottom 14 of the outer cup 10 (which is shown diagrammatically in FIG. 22). A central aperture 70A is provided in the seal member inner portion 68A that lines up with the outer cup's communication port 34 and provides part of the communication channel 32. A peripheral skirt 66A extends radially outwardly from the inner portion 68A. The seal member 63A could be provided by a conventional rubber washer (or a washer made of other flexible nonporous material) similar to that shown in FIG. 19, except that the central aperture 70A can be smaller because the seal member attaches to the bottom 14 of the outer cup 10, not its sidewall 16.

Figure 22A:
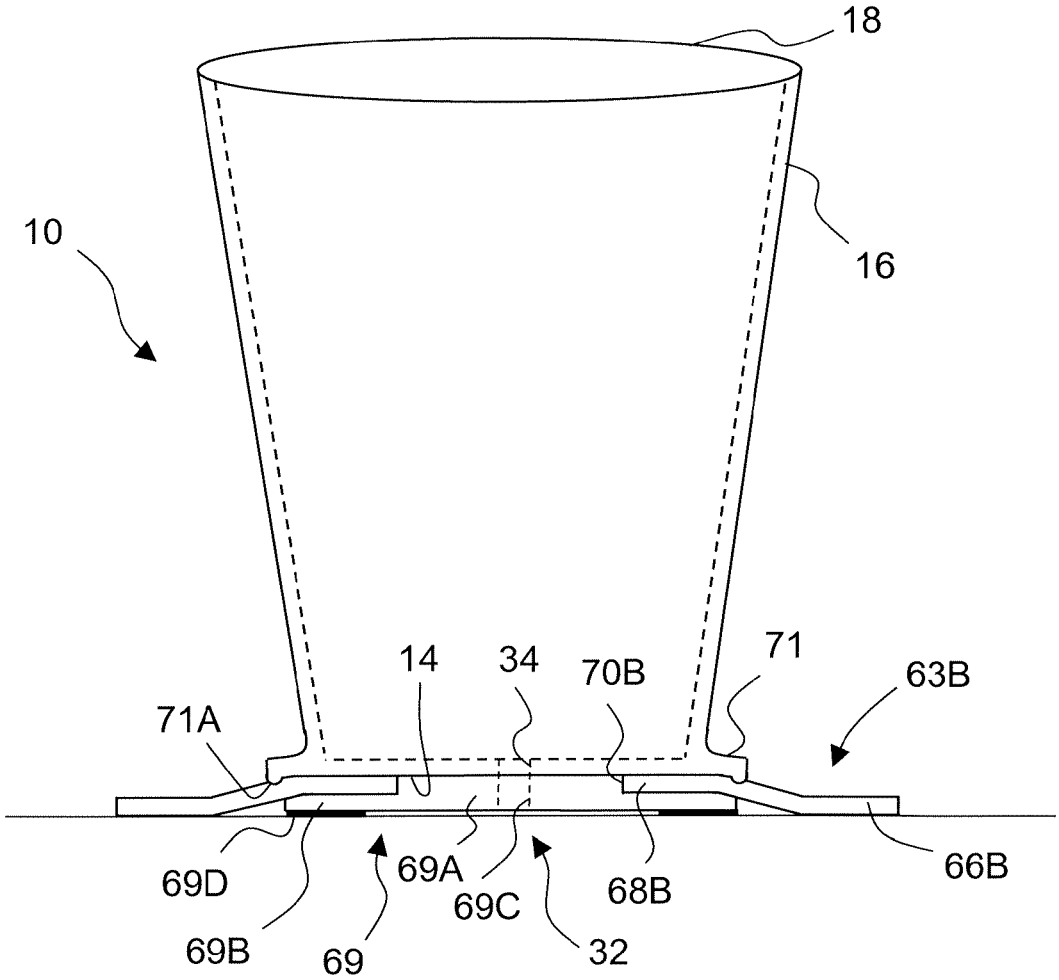
FIG. 22A is a cross-sectional centerline view of another exemplary seal member mounted on an exemplary beverage container outer cup.
Figure 23:
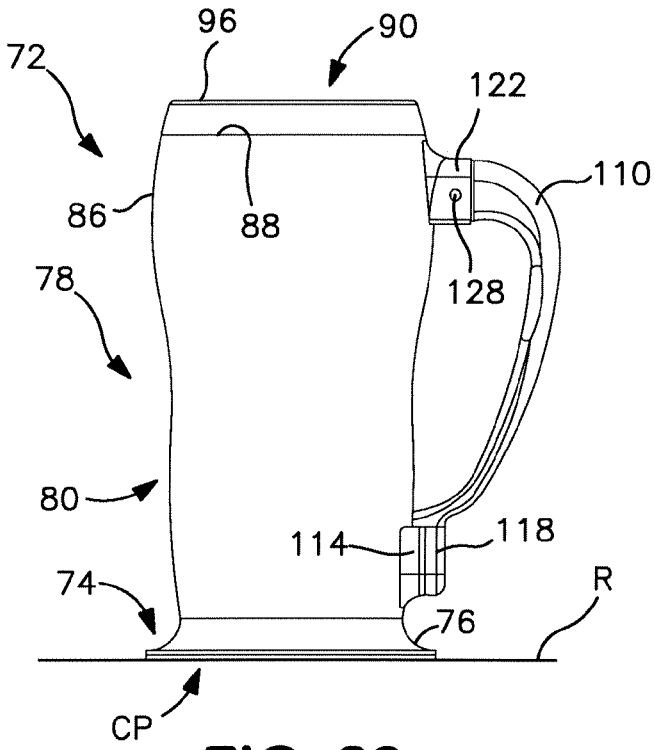
FIG. 23 is a side elevational view showing another exemplary self-anchoring beverage container with directional release and attachment capability.
Figure 24:
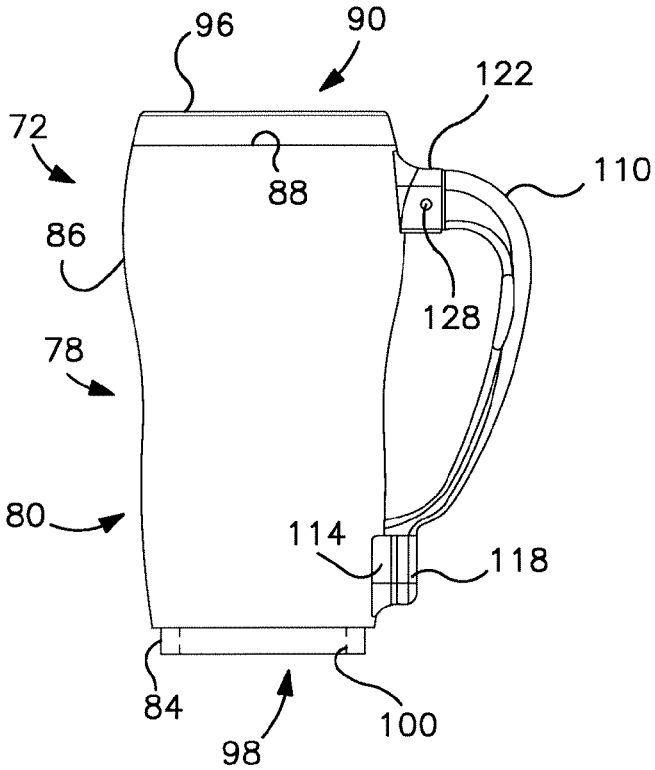
FIG. 24 is a side elevational view of the beverage container of FIG. 23 following removal of a base member thereof.

FIG. 22A shows a modified version 63B of the seal member 63 of FIG. 21 in which the lip structure 64 is again eliminated. Instead, the seal member 63B has an inner portion 68B that is attached to the bottom 14 of the outer cup 10 (which is shown diagrammatically in FIG. 22A) by way of a seal retainer 69. The seal retainer 69 includes a central hub portion 69A that mounts the seal member 63B, which has a correspondingly sized central aperture 70B. The seal retainer hub portion 69A is used for attaching the seal retainer 69 to the outer cup 10. Any suitable attachment arrangement may be used (e.g., adhesive, fasteners, etc.). A removable coupling arrangement will allow the seal retainer 69 to be removed so that the seal member 63B can be cleaned or replaced, if desired. The seal retainer 69 further includes an outer ring portion that provides a lower seal-shaping plate 69B. The lower plate 69B sandwiches the seal member 63B against the bottom of the outer cup 10. The outer cup 10 may be formed with an opposing upper seal-shaping plate 71 that engages the upper side of the seal member 63B.

Together, the plate members 69B and 71 provide a seal shaping system for controlling the shape of the seal member 63B. The lower plate 69B stabilizes the seal member 63B against forces that might cause it to curl downwardly. The upper plate 71 stabilizes the seal member 63B against forces that might cause it to curl upwardly. A slight camber may be imparted to the seal member 63B by making the outer diameter of the upper plate 71 somewhat larger than the outer diameter of the lower plate 69B, and by forming the underside of the upper plate's outer diameter with a small bead or other downward protuberance 71A. This camber causes the seal member 63B to curve slightly downwardly to form a small concavity beneath its lower surface.

A central aperture 69C is provided in the seal retainer hub portion 69A. The central aperture 69C lines up with the outer cup's communication port 34 and thus provides part of the communication channel 32. A peripheral skirt 66B extends radially outwardly from the inner portion 68B of the seal member 63B. The seal member 63B could be provided by a conventional rubber washer (or a washer made of other flexible nonporous material) similar to that shown in FIG. 19, except that the central aperture 70B is sized to receive the seal retainer hub portion 69A. An optional anti-skid member 69D may be formed on the bottom of the seal retainer 69. The anti-skid member 69D may be ring-shaped or implemented in any other suitable configuration. It may also be implemented using plural anti-skid elements. The anti-skid member 69D may be formed from any suitable non-slip material, such as silicone rubber, neoprene, etc. It can be formed on the seal retainer 69A using an over-molding process or attached thereto using any other suitable technique. The anti-skid member 69D prevents lateral sliding of the outer cup 10 when the latter is sealed against a surface by the seal member 63B. The sealing force provided by the seal member 63B develops a friction force between the anti-skid member 69D and the surface, thereby preventing the outer cup 10 from sliding on the surface. It will be appreciated that the anti-skid member 69D may also be used with other disclosed embodiments wherein the outer cup would otherwise contact the surface supporting the beverage container.

Turning now to FIGS. 23-26, another exemplary embodiment 72 of a self-anchoring beverage container with directional release and attachment capability is shown. Like the beverage container 2 described above, the beverage container 72 is configured as a mug for drinking hot beverages such as coffee, tea or the like, but it will be appreciated that other types of beverage containers could also be implemented. Unlike, the beverage container 2, there is no need for an inner cup to slideably move relative to an outer cup. Indeed, there is no need for an inner cup at all unless such is desired for insulation purposes.

The beverage container 72 includes a flexible nonporous base member 74 having a skirt 76 that seals to a reference surface R to form a controlled pressure zone CP. The base member 74 that can be selected from any of the seal member designs discussed above in connection with FIGS. 11-22. The beverage container 72 also includes a receptacle assembly 78 that comprises an outer cup 80 and an optional inner cup 82 (FIG. 26), but these components are not slideably engaged as in the beverage container 2. Instead, the inner cup 82 may be fixedly mounted within the outer cup 80. Moreover, the inner cup 82 may be fused to the outer cup 80 or it may be eliminated entirely to provide a single-cup receptacle assembly. The outer cup 80 can be configured with a bottom 84, a sidewall portion 86 and an open top 88. The inner cup 82, if present, can be configured as a vessel that comprises a beverage holding chamber 90 having a closed bottom 92, a sidewall portion 94, and an open (or partially open) top 96. The top 96 of the inner cup 82 may extend above the inner cup 80, but this not essential.

A communication channel 98 extends from the controlled pressure zone CP, which is on the lower side of the outer cup bottom 84, to an area of ambient air pressure that is represented by the environment outside of the outer cup 80. The communication channel 98 may be provided by a large aperture 100 in the outer cup bottom 84 that is sized to snuggly receive the bottom 92 of the inner cup 82. An air flow cavity 102 is defined in the receptacle assembly 78 by an angled surface 104 extending from the bottom 92 to the sidewall portion 94 of the inner cup 82. This cavity 102 forms part of the communication channel 98. The communication channel 98 additionally includes a communication port 106 (FIG. 25) that is formed in the outer cup sidewall portion 96 to vent the cavity 102. If the beverage container 72 is constructed without the inner cup 82, the communication channel 98 can be formed by a wall (not shown) spaced from the outer cup bottom 82. This wall may be angled in the same manner as the angled surface 104 shown in FIG. 26, or it may be substantially parallel to the lower edge of the outer cup bottom 84, so long as the wall is high enough to expose the communication port 106. Alternatively, the communication channel can be provided by a tube or other conduit (similar to that shown in FIG. 27) extending from the communication port 106 to the outer cup bottom 84.

Figure 25:
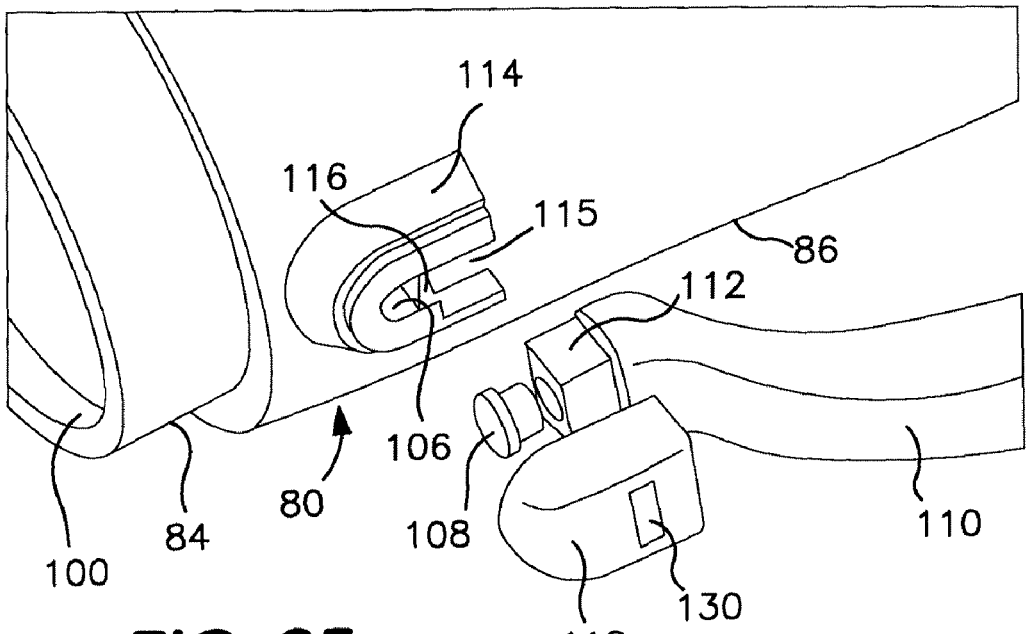
FIG. 25 is a detailed partial perspective view of the beverage container of FIG. 23 showing a pressure control valve incorporated in a handle thereof.

As shown in FIG. 25, a pressure control device can be implemented by way of a plug seal 108 made from rubber or other suitable seal material that mounts to the bottom of a handle 110 that is slideably mounted to the outer cup 80, and which provides a grasping portion of the beverage container 72. The seal 108 is adapted to sealably close the communication port 106 in the outer cup 80. It can be formed as a plug that mounts to a lower flange 112 at the bottom of the handle 110. A lower boss 114 proximate to the lower end of the outer cup sidewall portion 86 defines a channel 115 that slideably receives the handle flange 112. The boss 114 also defines a seal seat 116 at the base of the channel 115 that is configured to receive the head of the seal 108 and which has an opening therein to the communication port 106. A cap 118 is adapted to mount to the boss 114 and is used to close the communication port 106, the channel 115 and the seal seat 116, and to capture the seal 108 and the lower flange 112.

Figure 26:
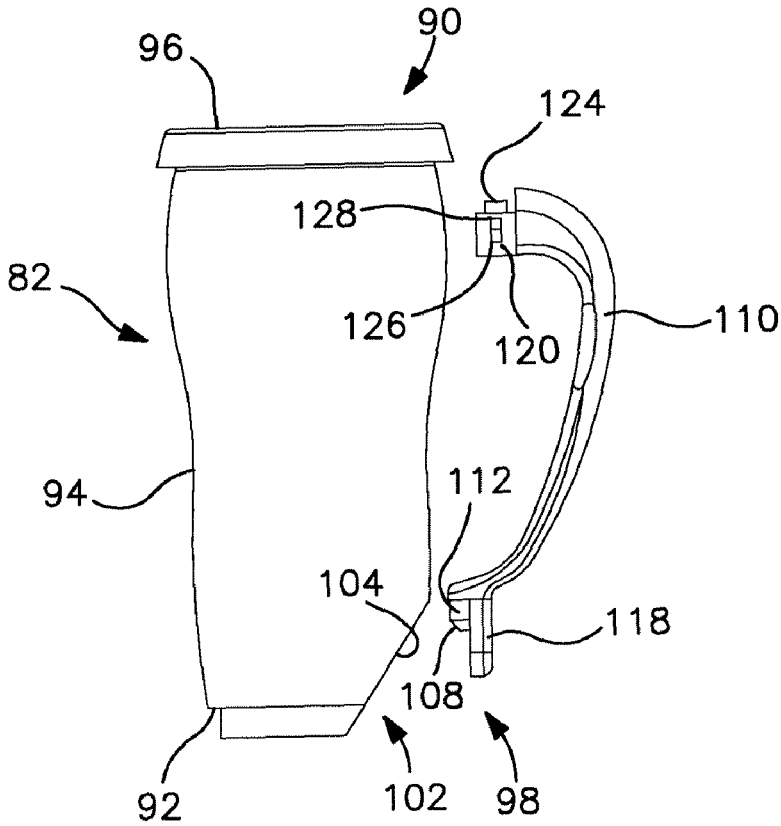
FIG. 26 is an exploded view showing an inner cup and a handle of the beverage container of FIG. 23.

The upper end of the handle 110 is slidably mounted to the outer cup 80. In particular, as shown in FIG. 26, an upper flange 120 at the top of the handle 110 mounts to an upper boss 122 (FIGS. 23-24) proximate to the upper end of the outer cup sidewall portion 86. The upper flange 120 includes a guide post 124 that is received within a corresponding guide slot (not shown) in the upper boss 122. The handle's upper flange 120 further includes a vertical slot 126 that receives a pin 128 extending through the upper boss 122. The pin 128 retains the upper end of the handle 110 while allowing it to slide up and down relative to the outer cup 80.

Because the seal 108 is mounted to the handle 110, and the handle is slideably disposed on the outer cup 80, the pressure control device provided by the seal 108 (which is part of the handle) will have a closed position that closes the communication channel 98 and seals the controlled pressure zone CP, and an open position that opens the communication channel to vent the controlled pressure zone to ambient pressure. As can be seen in FIG. 25, a vent slot 130 can be formed in the cap 118 to receive airflow from the ambient environment. Thus, it will be seen that the beverage container 72 is self anchoring and has a directional release and attachment capability that is activated by normal lifting of the beverage container from the reference surface R. As part of this normal lifting, the handle 110 (serving as the receptacle assembly grasping portion) will be grasped and lifted. This grasping and lifting will raise the handle 110 from a lowered position wherein the seal 108 closes the communication port 106 to a raised position wherein the seal is separated from the communication port, thereby opening the communication channel 98 and venting the controlled pressure zone CP to atmosphere.

Figure 27:
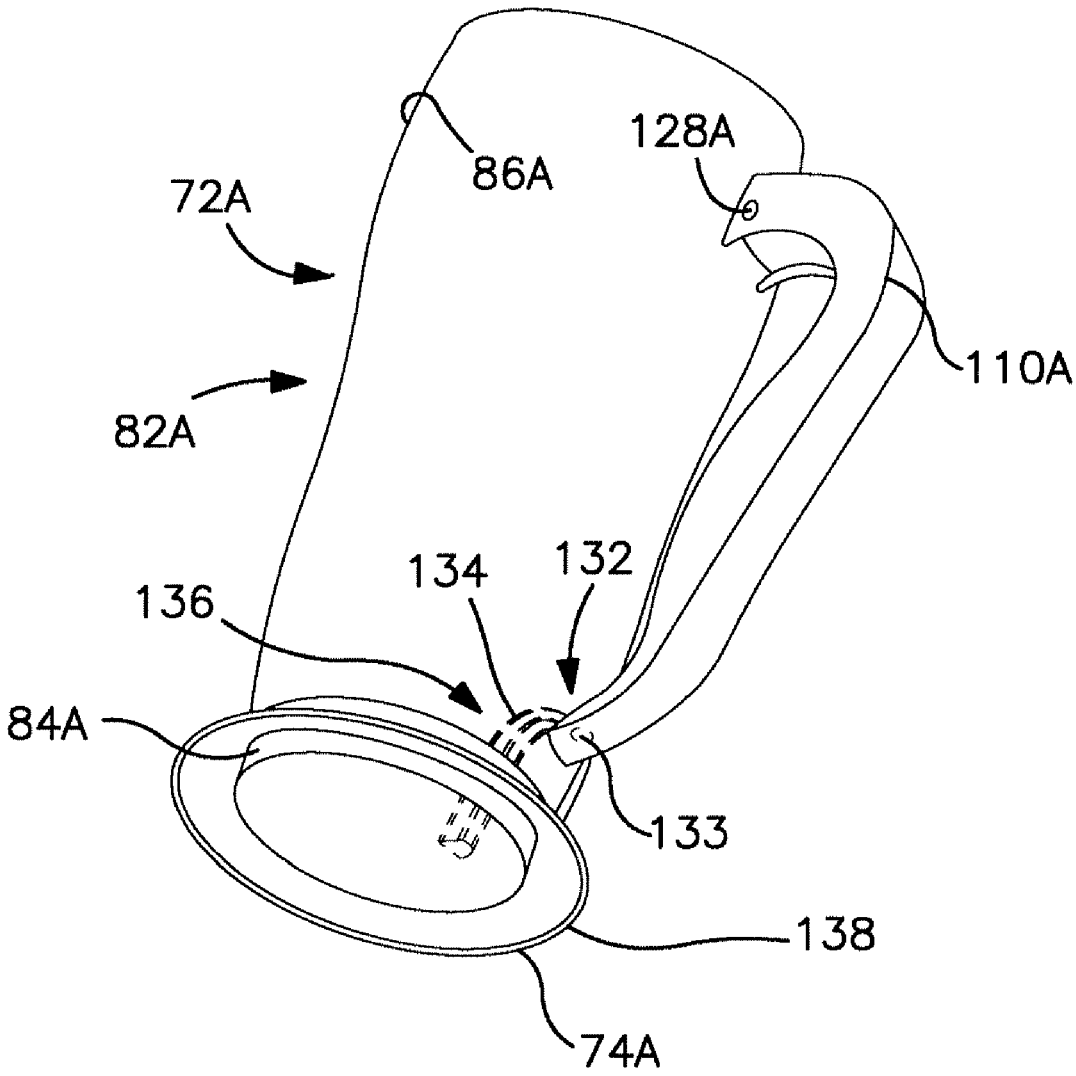
FIG. 27 is a perspective view showing another exemplary self-anchoring beverage container with directional release and attachment capability.

Turning now to FIG. 27, a modification 72A of the beverage container 72 is shown. The beverage container 72A is similar to the beverage container 72. However, in the beverage container 72A, the handle 110A does not slide and instead pivots about a pivot pin 128A. This actuates a plunger assembly 132 at the lower end of the handle 110A. The plunger assembly includes a plug seal (not shown) that seals a communication port 133 formed proximate to a lower end of the outer cup sidewall portion 86A. The communication port 133 terminates a communication channel that may be similar to the communication channel 98 of FIGS. 23-26. Alternatively, a modified communication channel 134 may be provided that includes a passageway 136 (such as a tube or conduit) to an aperture 138 in the outer cup bottom 84A. Again, in this configuration, it is entirely possible to form the beverage container 72A without an inner cup. The plunger assembly 132 may be designed to operate by pivoting the lower end of the handle 110A either away from or toward the communication port 133, depending on design preferences. In one configuration, the beverage container 72A and the handle 110A would be ergonomically designed so that when a person lifted the handle to pick up the beverage container, the handle would pivot in a direction that causes the bottom of the handle to move away from the outer cup sidewall 86A. In that case, the plunger assembly 132 would be designed to open the communication port 133 in response to such outward movement. In another configuration, the beverage container 72A and the handle 110A would be ergonomically designed so that when a person lifted the handle to pick up the beverage container, the handle would pivot in a direction that causes the bottom of the handle to move into the outer cup sidewall 86A. The plunger assembly 132 would then be designed to open the communication port 133 in response to such inward movement.

Figure 28:
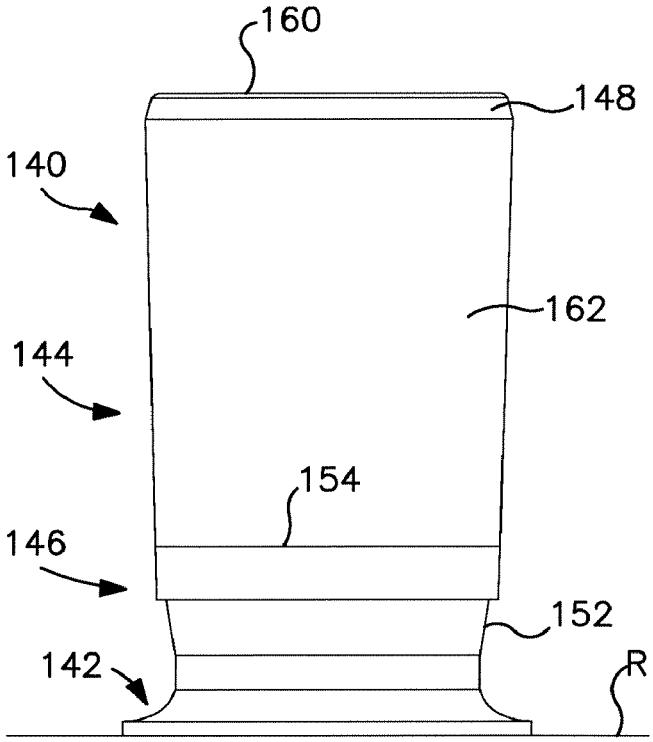
FIG. 28 is a side elevational showing another exemplary self-anchoring beverage container with directional release and attachment capability.
Figure 29:
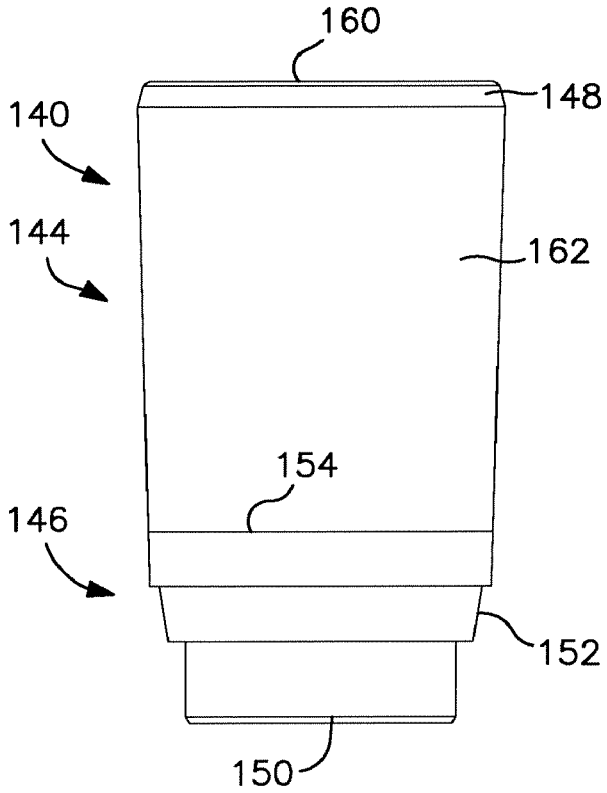
FIG. 29 is a side elevational view showing the beverage container of FIG. 28 following removal of a base member thereof.
Figure 30:
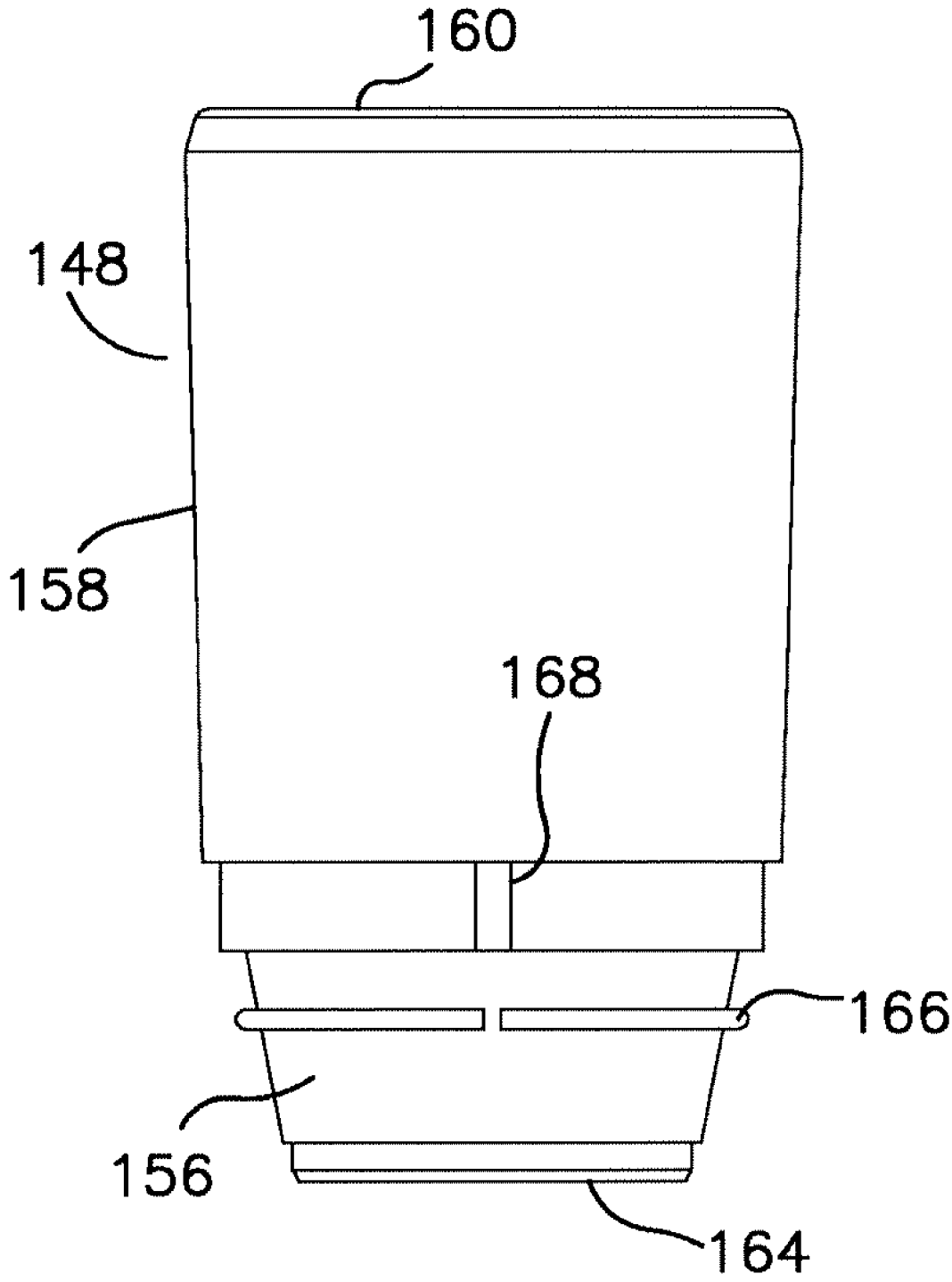
FIG. 30 is a side elevational view showing the beverage container of FIG. 28 following removal of an outer cup thereof.

Turning now to FIGS. 28-30, another exemplary embodiment 140 of a self-anchoring beverage container with directional release and attachment capability is shown. The beverage container 140 is similar to the previously described beverage container 2 in that there is a base member 142 and a receptacle assembly 144 having slideably engaged outer and inner cups 146 and 148. However, as shown in FIG. 29, the outer cup 146 is much shorter than the inner cup 148. This can be seen by the location of the outer cup bottom 150, sidewall portion 152 and top 154. As shown in FIG. 30, the inner cup 148 is much taller, as can be see by the location of its closed bottom 156, sidewall portion 158 and an open (or partially open) top 160. It will be seen that the inner cup 148 does not require a handle due to the fact that so much of the inner cup extends above the outer cup 146. The upper portion 162 of the inner cup 148 that would normally be grasped by a user in order to lift a glass provides a grasping portion of the receptacle assembly 144. A blanket seal 164 on the inner cup's bottom 156 is adapted to seal a communication port (not shown) in the bottom of the outer cup 146 that forms part of a communication channel for venting the controlled pressure zone CP provided by the base member 142. A coupling is provided to limit slideable movement of the inner cup 148 relative to the outer cup 146. This coupling may include a ridge 166 that is formed proximate to the inner cup's bottom 156. The ridge 166 engages corresponding structure (not shown) situated on the inside of the outer cup sidewall portion 152. To prevent rocking of the inner cup 148 relative to the outer cup 146, one or more guides 168 may be formed on the inner cup sidewall portion 158 that engage corresponding structures (not shown) on the inside of the outer cup sidewall portion 152. For example, the guides 168 could be implemented as vertical ridges and the corresponding structure on the outer cup sidewall portion 152 could be implemented as matching slots. The operation of the beverage container 140 is otherwise similar to that of the beverage container 2, and its description will not be repeated here.

Figure 31:
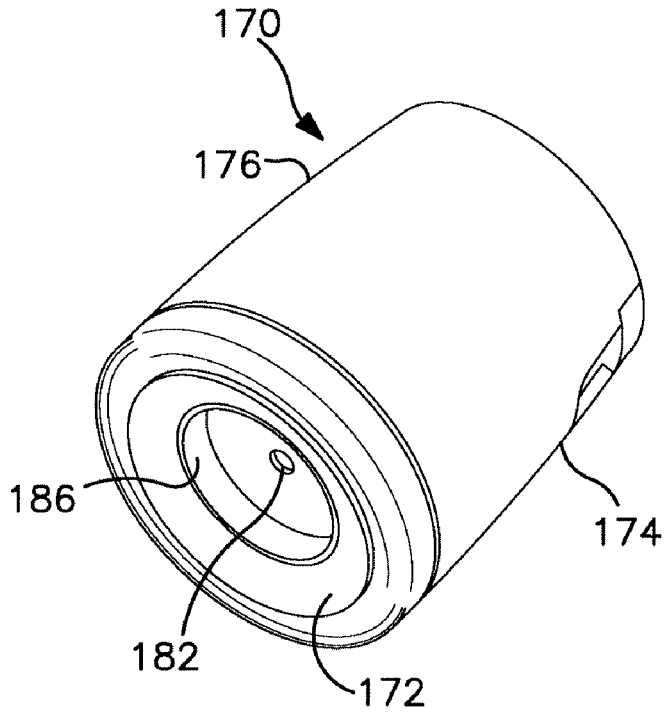
FIG. 31 is a perspective view showing another exemplary self-anchoring beverage container with directional release and attachment capability.
Figure 32:
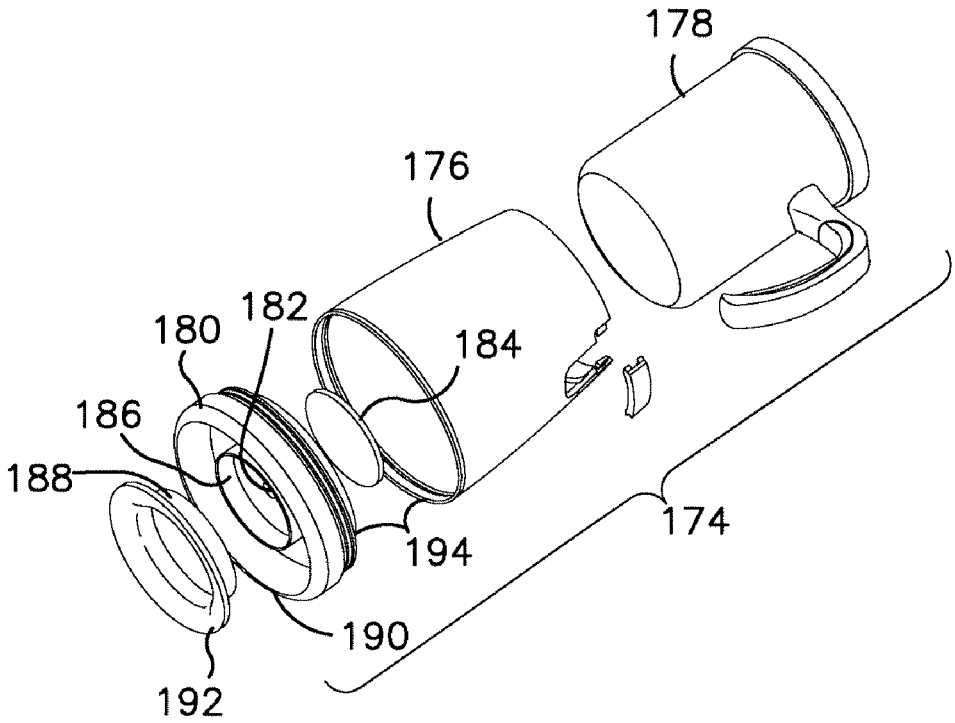
FIG. 32 is an exploded perspective view of the beverage container of FIG. 31.
Figure 33:
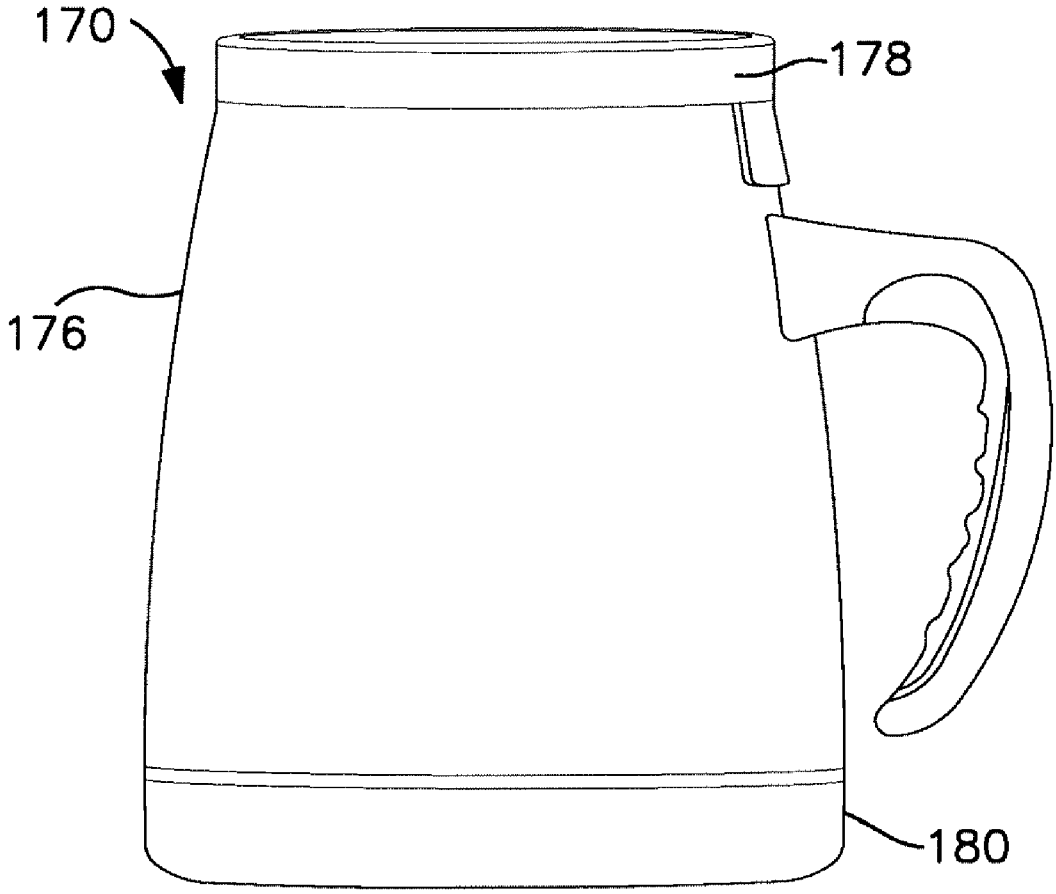
FIG. 33 is a side elevational view of the beverage container of FIG. 31.

Turning now to FIGS. 31-33, another exemplary embodiment 170 of a self-anchoring beverage container with directional release and attachment capability is shown. The beverage container 170 is similar to the previously described beverage container 2 in that there is a base member 172 and a receptacle assembly 174 having slideably engaged outer and inner cups 176 and 178. The bottom 180 of the outer cup 176 is formed with a central communication port 182 that provides a communication channel. The inner cup 178 includes a blanket seal 184 that is designed to seal the communication port 182 when the beverage container 170 is the static mode resting on a reference surface (not shown). The outer cup bottom 180 is also designed to cover the base member 172 so that it is not visible when the beverage container 170 is in the static mode. This further contributes to stealth operation because the beverage container 170 looks like an ordinary container, as can be seen in FIG. 33. In order to hide the base member 172, the outer cup bottom 180 is formed with a central flange 186 that mounts the base member 172. In particular, a central aperture 188 on the base member 172 can be removably or permanently mounted to the central flange 186. Any suitable mounting arrangements may be used, including any of the arrangements shown for the seal members of FIGS. 11-22, with suitable modifications being made to the configuration of the central flange 186 as necessary. A large annular cavity 190 in the outer cup bottom 180 surrounds the central flange 186 and provides a space for receiving the base member's peripheral skirt 192. It will also be seen in FIG. 32 that the outer cup bottom 180 could be formed as a separate piece that mounts to the remainder of the outer cup 176, as by a threaded attachment configuration 194.

Accordingly, a self-anchoring beverage container with directional release and attachment capability has been disclosed. The beverage container allows beverages and other consumables to be ingested with minimal risk of spillage due to container tipping. During use, the beverage container may be effortlessly stabilized against tipping by simply placing the beverage container on a reference surface. The beverage container may then be effortlessly released by simply performing normal lifting of the beverage container using the beverage container's grasping portion. Although exemplary embodiments have been shown and described, it should be apparent that many variations and alternative embodiments could be implemented in accordance with the teachings herein. It is understood, therefore, that the invention is not to be in any way limited except in accordance with the spirit of the appended claims and their equivalents.

What is claimed is:

1. A self-anchoring beverage container with directional release and attachment capability, comprising:

a flexible nonporous base member;

said base member having a lower surface that is configured to engage an external reference surface and form a substantially airtight peripheral seal therewith that defines a controlled pressure zone, said controlled pressure zone being a region located between said base member and said reference surface that is surrounded by said peripheral seal;

a receptacle assembly mounted to said base member;

said receptacle assembly comprising a beverage holding chamber having a closed bottom, a sidewall portion, and a top;

said receptacle assembly having a lower end portion configured to contact said external reference surface within said controlled pressure zone when said base member forms said substantially airtight seal with said reference surface;

said receptacle assembly further comprising a communication channel arranged to provide air communication between said controlled pressure zone and an area of ambient air pressure;

said receptacle assembly further comprising a pressure control device, said pressure control device having a closed position wherein said pressure control device blocks and closes said communication channel to seal said controlled pressure zone and an open position wherein said pressure control device separates from and opens said communication channel to vent said controlled pressure zone to ambient pressure;

said receptacle assembly further comprising a grasping portion that is arranged to be grasped by a user during normal lifting of said beverage container from said reference surface;

said pressure control device and said grasping portion being part of a common rigid structure so that said grasping portion cannot move without causing simultaneous movement of said pressure control device, said rigid structure producing simultaneous actuation of said pressure control device from said closed position to open said communication channel when a user grasps said grasping portion and initiates said normal lifting of said beverage container from said reference surface;

whereby said beverage container is self-biased to remain affixed to said reference surface when said communication channel is closed due to said controlled pressure zone generating a partial vacuum when an attempt is made to move said beverage container without actuating said pressure control device; and whereby said self-biasing will be released surreptitiously and said beverage container will lift away from said reference surface without discernible resistance when said pressure control device is actuated to vent said controlled pressure zone due to a user grasping said grasping portion during normal lifting of said beverage container.

2. The beverage container of claim 1, wherein said base member is configured to engage only a bottom portion of said receptacle assembly.

3. The beverage container of claim 1, wherein there is only a single base member that is sized such that said controlled pressure zone extends outside of a foot print of a lower sidewall portion of said receptacle assembly.

4. The beverage container of claim 1, wherein said grasping portion comprises a handle portion of said receptacle assembly.

5. The self-anchoring beverage container of claim 1, further including a shaping system for controlling a shape of said base member.

6. The self-anchoring beverage container of claim 1, further including an anti-skid member on a bottom of said receptacle assembly, said anti-skid member being positioned to engage said reference surface when said base member forms said substantially airtight seal with said reference surface.

7. The beverage container of claim 1, wherein said beverage holding chamber is provided by an inner cup member that is slideably mounted on an outer cup member of said receptacle assembly.

8. The beverage container of claim 7, wherein said inner cup member is slideably received within an interior of said outer cup member.

9. The beverage container of claim 7, wherein said inner cup member comprises said grasping portion, said pressure control device and said rigid structure.

10. The beverage container of claim 9, wherein said pressure control device comprises a pressure control seal on said inner cup member that is arranged to engage a communication port in said outer cup member that comprises part of said communication channel.

11. The beverage container of claim 10, wherein said pressure control seal is a blanket seal comprising a flexible nonporous material that is larger than said communication port.

12. A self-anchoring beverage container with directional release and attachment capability, comprising:

sealing means for forming a substantially airtight peripheral seal with an external reference surface and defining a controlled pressure zone, said controlled pressure zone being a region located between said container and said reference surface that is surrounded by said peripheral seal;

receptacle means for holding a beverage, said receptacle means being mounted to said sealing means;

said receptacle means having a lower end portion configured to contact said external reference surface within said controlled pressure zone when said base member forms said substantially airtight seal with said reference surface;

said receptacle means comprising air communication means for providing air communication between said controlled pressure zone and an area of ambient air pressure;

said receptacle means further comprising pressure control means for selectively closing said communication means to seal said controlled pressure zone and opening said communication means for vent said controlled pressure zone to ambient pressure;

said receptacle means further comprising a grasping portion that is arranged to be grasped by a user during normal lifting of said beverage container from said reference surface;

said pressure control means and said grasping portion being part of a common rigid structure so that said grasping portion cannot move without causing simultaneous movement of said pressure control means, said rigid structure producing simultaneous actuation of said pressure control means to open said communication means when a user grasps said grasping portion and initiates said normal lifting of said beverage container from said reference surface;

whereby said beverage container is self-biased to remain affixed to said reference surface when said communication means is closed due to said controlled pressure zone generating a partial vacuum when an attempt is made to move said beverage container without actuating said pressure control means; and whereby said self-biasing will be released surreptitiously and said beverage container will lift away from said reference surface without discernible resistance when said pressure control means is actuated to vent said controlled pressure zone due to a user grasping said grasping portion during normal lifting of said beverage container.

13. The self-anchoring beverage container of claim 12, further including an anti-skid member on a bottom of said receptacle means, said anti-skid member being positioned to engage said reference surface when said sealing means forms said substantially airtight seal with said reference surface.

14. The self-anchoring beverage container of claim 12, wherein said receptacle means comprises air gap insulating means for insulating a beverage.

15. The self-anchoring beverage container of claim 12, further including a seal shaping system for controlling a shape of said sealing means.

16. The self-anchoring beverage container of claim 15, wherein said sealing means comprises a flexible nonporous seal member mounted to a bottom of said receptacle means, and wherein said seal shaping system comprises a pair of upper and lower plates sandwiching said seal member.

17. The self-anchoring beverage container of claim 16, wherein said lower plate comprises part of a seal retainer that mounts said seal member to said receptacle means and provides said lower end portion of said receptacle means that contacts said reference surface.

18. The self-anchoring beverage container of claim 16, wherein said upper plate comprises part of said receptacle means and includes a protuberance that imparts a camber to said seal member by causing said seal member to curve downwardly to form a concavity.

19. The self-anchoring beverage container of claim 5, wherein said base member comprises a flexible nonporous seal member mounted to a bottom of said receptacle assembly, and wherein said shaping system comprises a pair of upper and lower plates sandwiching said seal member.

20. The self-anchoring beverage container of claim 19, wherein said lower plate comprises part of a seal retainer that mounts said seal member to said receptacle assembly and provides said lower end portion of said receptacle assembly that contacts said reference surface.

21. The self-anchoring beverage container of claim 19, wherein said upper plate comprises part of said receptacle assembly and includes a protuberance that imparts a camber to said seal member by causing said seal member to curve downwardly to form a concavity.

* * * * *